US008201529B2

(12) United States Patent
Yamaguchi et al.

(10) Patent No.: US 8,201,529 B2
(45) Date of Patent: Jun. 19, 2012

(54) VALVE TIMING ADJUSTING APPARATUS

(75) Inventors: Takashi Yamaguchi, Obu (JP); Osamu Sato, Takahama (JP)

(73) Assignee: Denso Corporation, Kariya (JP)

( * ) Notice: Subject to any disclaimer, the term of this patent is extended or adjusted under 35 U.S.C. 154(b) by 559 days.

(21) Appl. No.: 12/425,765

(22) Filed: Apr. 17, 2009

(65) Prior Publication Data

US 2009/0260591 A1 Oct. 22, 2009

(30) Foreign Application Priority Data

Apr. 18, 2008 (JP) ..... 2008-109346

(51) Int. Cl.
*F01L 1/34* (2006.01)

(52) U.S. Cl. ..... 123/90.17

(58) Field of Classification Search ..... 123/90.15, 123/90.17

See application file for complete search history.

(56) References Cited

U.S. PATENT DOCUMENTS

| | | | | |
|---|---|---|---|---|
| 5,738,056 | A | 4/1998 | Mikame et al. | |
| 6,374,788 | B1 | 4/2002 | Fukuhara et al. | |
| 6,460,496 | B2 | 10/2002 | Fukuhara et al. | |
| 6,484,678 | B2 * | 11/2002 | Kinugawa | 123/90.17 |
| 6,739,298 | B2 * | 5/2004 | Kusano et al. | 123/90.17 |
| 6,935,291 | B2 * | 8/2005 | Kusano et al. | 123/90.17 |
| 7,059,286 | B2 * | 6/2006 | Kusano et al. | 123/90.17 |
| 7,100,555 | B2 * | 9/2006 | Imaizumi et al. | 123/90.17 |
| 2002/0139332 | A1 | 10/2002 | Takenaka | |
| 2006/0266318 | A1 * | 11/2006 | Suga et al. | 123/90.17 |

FOREIGN PATENT DOCUMENTS

| | | |
|---|---|---|
| JP | 2002-256826 | 9/2002 |
| JP | 2002-357105 | 12/2002 |
| JP | 2007-154669 | 6/2007 |

OTHER PUBLICATIONS

Korean Office Action dated Feb. 7, 2011, issued in corresponding Korean Application No. 10-2009-0033695, with English translation.
Japanese Office Action dated Mar. 30, 2010, issued in corresponding Japanese Application No. 2008-109346, with English translation.
Chinese Office Action dated May 10, 2011, issued in corresponding Chinese Application No. 200910132745.2 with English translation.
Japanese Office Action dated Aug. 3, 2010, issued in corresponding Japanese Application No. 2008-109346, with English translation.

* cited by examiner

*Primary Examiner* — Thomas Denion
*Assistant Examiner* — Daniel Bernstein
(74) *Attorney, Agent, or Firm* — Nixon & Vanderhye PC

(57) ABSTRACT

A valve timing adjusting apparatus includes a housing, a vane rotor, and a fluid path arrangement. The fluid path arrangement is provided inside the housing. The fluid path arrangement opens to air outside the housing. The fluid path arrangement is communicated with a specific fluid chamber that is one of an advance fluid chamber and a retard fluid chamber defined within the housing. A rotational phase of the vane rotor relative to the housing is changed in one of advance and retard directions when hydraulic oil is introduced into the specific fluid chamber. The valve timing adjusting apparatus controls the fluid path arrangement to be opened and closed.

8 Claims, 13 Drawing Sheets

FIG. 8A
FIG. 8B
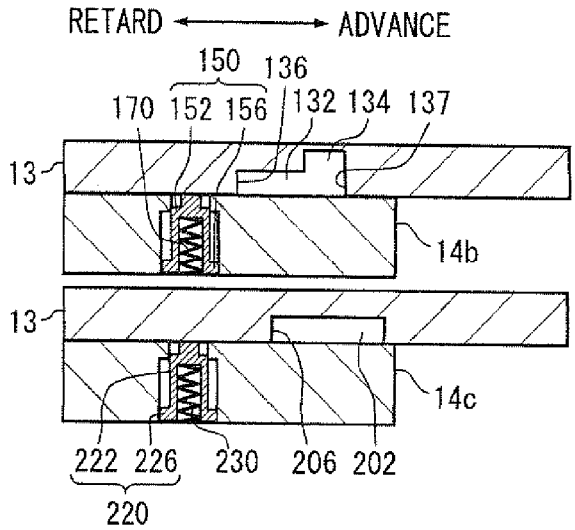
FIG. 8C
FIG. 8D
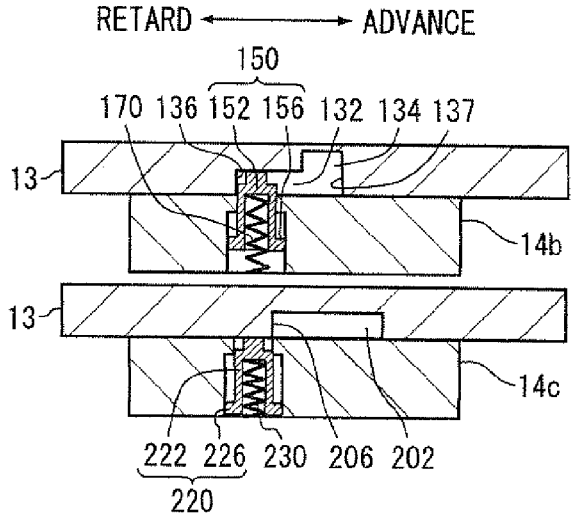
FIG. 8E
FIG. 8F
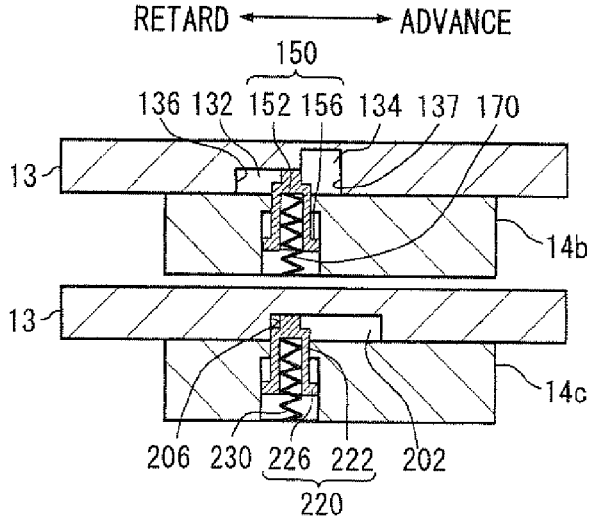

FIG. 8G
FIG. 8H
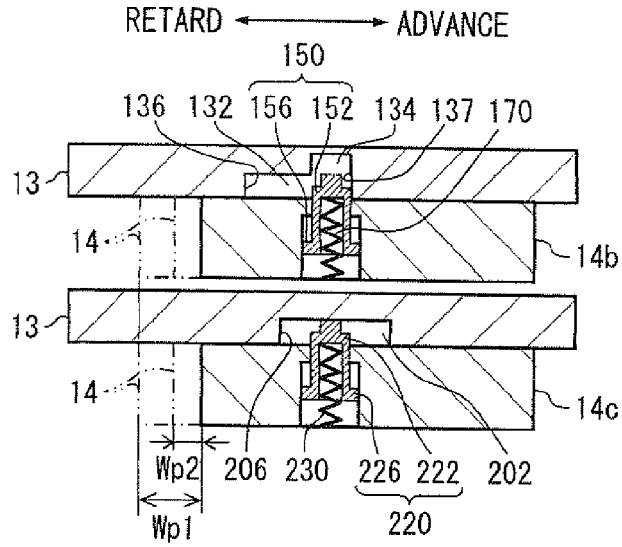
FIG. 8I
FIG. 8J
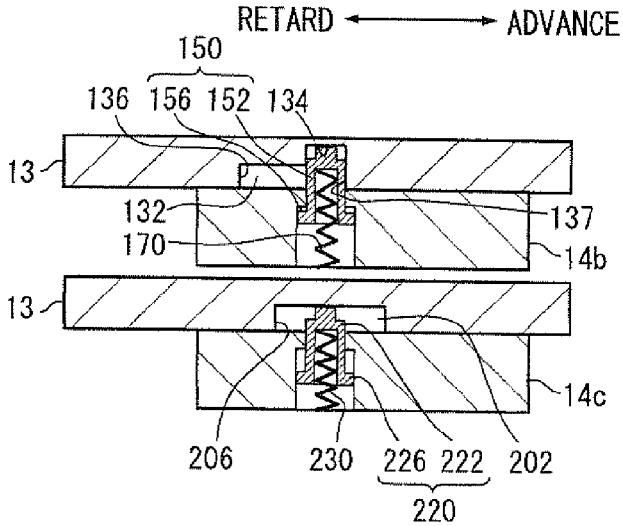
FIG. 8K
FIG. 8L
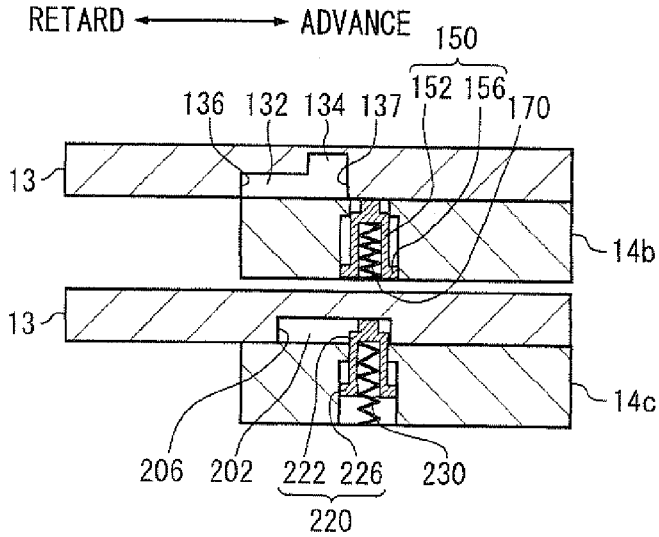

VALVE TIMING ADJUSTING APPARATUS

CROSS REFERENCE TO RELATED APPLICATION

This application is based on and incorporates herein by reference Japanese Patent Application No. 2008-109346 filed on Apr. 18, 2008.

BACKGROUND OF THE INVENTION

1. Field of the Invention

The present invention relates to a valve timing adjusting apparatus for controlling valve timing of a valve that is opened and closed by a camshaft through torque transmitted from a crankshaft of an internal combustion engine.

2. Description of Related Art

A conventional hydraulic valve timing adjusting apparatus is known to include a housing and a vane rotor and to adjust valve timing using hydraulic oil supplied from a supply source, such as a pump. The housing is rotatable synchronously with a crankshaft of an internal combustion engine, and the vane rotor is rotatable synchronously with a camshaft of the internal combustion engine. In general, in the hydraulic valve timing adjusting apparatus, the vane rotor has a vane that defines inside the housing into an advance fluid chamber and a retard fluid chamber that are arranged in a circumferential direction. The introduction of hydraulic oil from the supply source into the advance fluid chamber or the retard fluid chamber changes a rotational phase of the vane rotor relative to the housing correspondingly in an advance direction or a retard direction in order to adjust the valve timing.

JP-A-2002-357105 corresponding to US20020139332 shows a hydraulic valve timing adjusting apparatus that regulates a change of the rotational phase within a range or a region between a full advance phase and a full retard phase. More specifically, in the apparatus of JP-A-2002-357105, before stopping of the internal combustion engine, a pin supported by the vane rotor is fitted with the vane rotor. As a result, the rotational phase is regulated to be changeable within a start phase region that allows the internal combustion engine to start, and the above state of the rotational phase regulated in the start phase region remains the same until the starting of the internal combustion engine in the next operation. Thus, startability of the internal combustion engine or engine startability is substantially achieved.

In the apparatus of JP-A-2002-357105, the internal combustion engine may stop instantly due to the occurrence of abnormality, the internal combustion engine may be locked before the pin regulates the rotational phase within the start phase region. In the above state, cranking of the internal combustion engine starts in a state, where the rotational phase is set out of the start phase region, and thereby the engine startability may deteriorate disadvantageously.

Thus, the inventors have studied a technique, in which the rotational phase, which is out of the start phase region, is changed to stay within the start phase region in order to achieve sufficient engine startability. Then, it is found that the engine startability is sufficiently achieved by introducing hydraulic oil into a specific fluid chamber at the time of starting of the internal combustion engine by cranking the engine. In the above, The specific fluid chamber corresponds to one of the advance and retard fluid chambers, and when hydraulic oil is introduced to the specific fluid chamber, the rotational phase is changed to stay within the start phase region.

However, in a low-temperature environment, where hydraulic oil has a high degree of viscosity, the inventors have found after the further study that the above technique may not achieve the desired engine startability disadvantageously. Then, after intense study, the inventors further found that in an apparatus, in which torque from the camshaft is applied to the vane rotor at the starting of the internal combustion engine, when force caused by the variation of the torque is applied to the vane rotor in a direction to change the rotational phase to the start phase region, the volume of the specific fluid chamber increases accordingly. Thus, in a case, where hydraulic oil has higher degree of viscosity, the introduction of the hydraulic oil into the specific fluid chamber may be delayed relative to the increase of the volume of the chamber, and thereby a negative pressure is prone to be generated in the specific fluid chamber. The generation of the negative pressure may deteriorate the rotation of the vane rotor relative to the housing, and thereby it may become difficult to change the rotational phase to the start phase region disadvantageously.

SUMMARY OF THE INVENTION

The present invention is made in view of the above disadvantages. Thus, it is an objective of the present invention to address at least one of the above disadvantages.

To achieve the objective of the present invention, there is provided a valve timing adjusting apparatus for an internal combustion engine having a camshaft and a crankshaft, the valve timing adjusting apparatus including a housing, a vane rotor, and a fluid path arrangement, wherein the valve timing adjusting apparatus uses hydraulic oil supplied from a supply source to adjust valve timing of a valve that is opened and closed by the camshaft through torque transmission from the crankshaft. The housing is rotatable synchronously with the crankshaft. The vane rotor is rotatable synchronously with the camshaft. The vane rotor has a vane that defines an advance fluid chamber and a retard fluid chamber that are arranged in the housing in a circumferential direction such that a rotational phase of the vane rotor relative to the housing is changed in an advance direction or in a retard direction when hydraulic oil supplied by the supply source is introduced into a corresponding one of the advance fluid chamber and the retard fluid chamber. The fluid path arrangement is provided inside the housing. The fluid path arrangement opens to air outside the housing. The fluid path arrangement is communicated with a specific fluid chamber that is one of the advance fluid chamber and the retard fluid chamber. The rotational phase is changed in a predetermined one of the advance and retard directions when hydraulic oil is introduced into the specific fluid chamber. The valve timing adjusting apparatus controls the fluid path arrangement to be opened and closed.

BRIEF DESCRIPTION OF THE DRAWINGS

The invention, together with additional objectives, features and advantages thereof will be best understood from the following description, the appended claims and the accompanying drawings in which:

FIGS. 8A and 8B are cross section schematic diagrams of the valve timing adjusting apparatus taken along lines VIIIA-VIIIA and VIIIB-VIIIB of FIG. 2, respectively, when a rotational phase corresponds to a full retard phase;

FIGS. 8C and 8D are cross section schematic diagrams of the valve timing adjusting apparatus when the rotational phase corresponds to a first regulation phase;

FIGS. 8E and 8F are cross section schematic diagrams of the valve timing adjusting apparatus when the rotational phase corresponds to a second regulation phase;

FIGS. 8G and 8H are cross section schematic diagrams of the valve timing adjusting apparatus when the rotational phase corresponds to a lock phase;

FIGS. 8I and 8J are cross section schematic diagrams of the valve timing adjusting apparatus when the rotational phase corresponds to the lock phase;

FIGS. 8K and 8L are cross section schematic diagrams of the valve timing adjusting apparatus when the rotational phase corresponds to a full advance phase;

DETAILED DESCRIPTION OF PREFERRED EMBODIMENTS

The present invention will be described with multiple embodiments with reference to accompanying drawings. In each of the embodiments, corresponding components are indicated by the same numeral, and thereby overlapped explanation will be omitted.

First Embodiment

Figure 1:
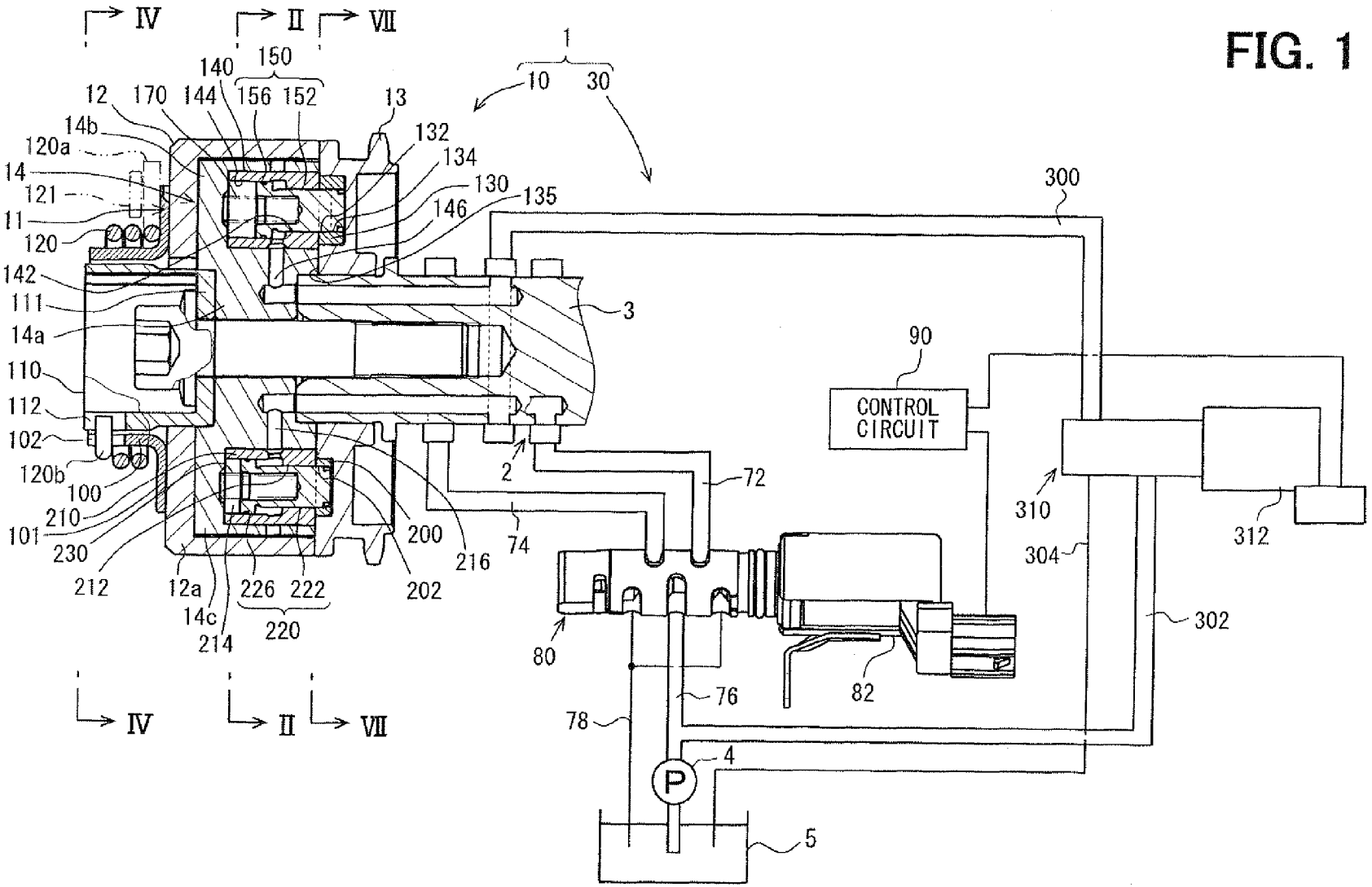
FIG. 1 is a configuration diagram illustrating a valve timing adjusting apparatus according to the first embodiment of the present invention and is a cross-sectional view take along line I-I in FIG. 2.

The first embodiment of the present invention will be described below with accompanying drawings. FIG. 1 shows an example, in which a valve timing adjusting apparatus 1 of the first embodiment of the present invention is applied to an internal combustion engine 2 of a vehicle. The valve timing adjusting apparatus 1 is a hydraulic apparatus and uses hydraulic oil supplied by a pump 4 in order to adjust valve timing of an intake valve that is opened and closed by a camshaft 3 of the internal combustion engine 2. The pump 4 serves as a "supply source", and the intake valve serves as a "valve".

(Basic Configuration)

A basic configuration of the valve timing adjusting apparatus 1 will be described below. The valve timing adjusting apparatus 1 includes a drive unit 10 and a control unit 30. The drive unit 10 is provided to a transmission system that transmits engine torque to the camshaft 3 from a crankshaft (not shown) of the internal combustion engine 2. The control unit 30 controls the operation of the drive unit 10.

(Drive Unit)

Figure 2:
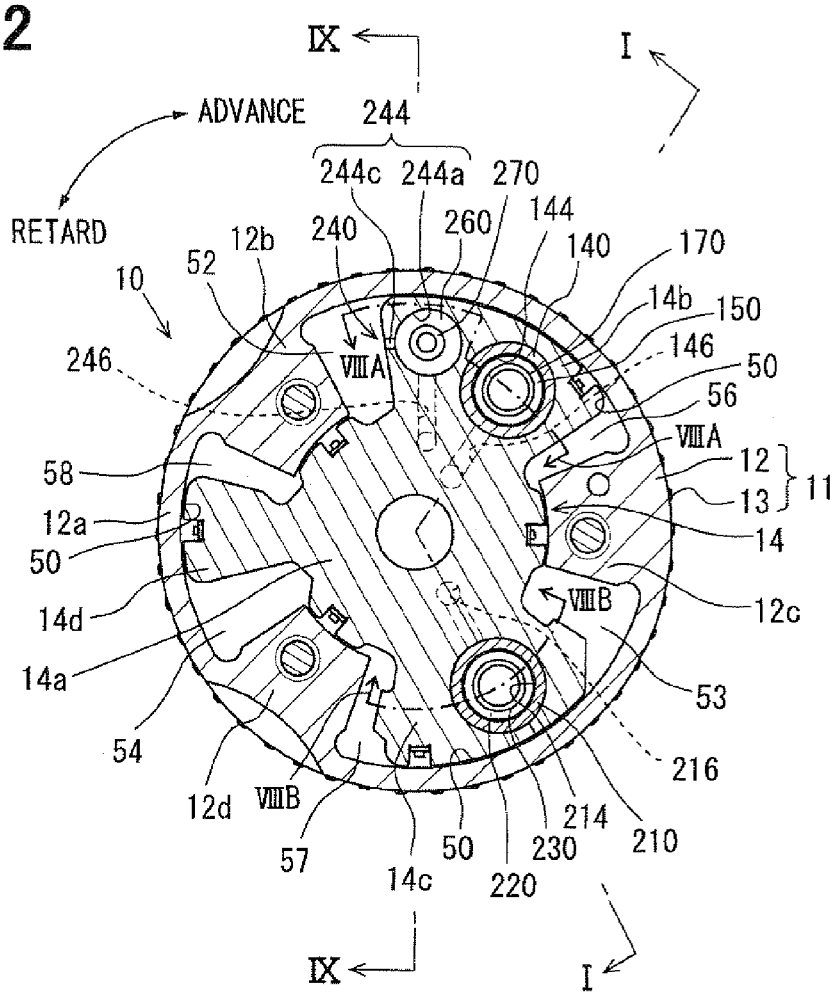
FIG. 2 is a cross-sectional view taken along line II-II in FIG. 1.

As shown in FIGS. 1 and 2, the drive unit 10 includes a housing 11 and a vane rotor 14, and the housing 11 has a shoe member 12 and a sprocket member 13.

The shoe member 12 is made of metal and has a tubular portion 12*a* and multiple shoes 12*b*, 12*c*, 12*d*. The tubular portion 12*a* has a hollow cylinder having one end open to the sprocket member 13 and having the other end closed by a bottom. The shoes 12*b* to 12*d* are arranged at the tubular portion 12*a* at equal intervals one after another in a circumferential direction and project radially inwardly from the tubular portion 12*a*. Each of the shoes 12*b* to 12*d* has a radially inner surface that has an arcuate shape taken along a plane perpendicular to an rotational axis of the vane rotor 14 as shown in FIG. 2. The radially inner surfaces of the shoes 12*b* to 12*d* slide on an outer peripheral surface of a hub portion 14*a* of the vane rotor 14. Adjacent ones of the shoes 12*b* to 12*d* in the circumferential direction define therebetween a corresponding receiving chamber 50.

The sprocket member 13 is made of metal to have an annular plate shape and is fixed coaxially to the opening end of the tubular portion 12*a* of the shoe member 12. The sprocket member 13 is drivingly linked to the crankshaft through a timing chain (not shown). As a result, during the operation of the internal combustion engine 2, transmission of the engine torque from the crankshaft to the sprocket member 13 causes the housing 11 to rotate synchronously with the crankshaft in a clockwise direction in FIG. 2.

As shown in FIGS. 1 and 2, the vane rotor 14 is made of metal and is received coaxially within the housing 11. The vane rotor 14 has opposite axial end portions that slide on the bottom wall of the tubular portion 12*a* of the shoe member 12 and the sprocket member 13. The vane rotor 14 has the hub portion 14*a* and multiple vanes 14*b*, 14*c*, 14*d*. The hub portion 14*a* has a column shape.

The hub portion 14*a* is fixed coaxially to the camshaft 3. As a result, the vane rotor 14 is rotatable synchronously with the camshaft 3 in the clockwise direction in FIG. 2, and also is rotatable relative to the housing 11. The vanes 14*b* to 14*d* are arranged at regular intervals from one after another in the circumferential direction at the hub portion 14*a* and project radially outwardly. Each of the vanes 14*b* to 14*d* is received in the corresponding receiving chamber 50. Each of the vanes 14*b* to 14*d* has a radially outer surface having an arcuate shape taken along the plane perpendicular to the rotational axis of the vane rotor 14 as shown in FIG. 2. The radially outer surfaces of the vanes 14*b* to 14*d* slide on an inner peripheral surface of the tubular portion 12*a*.

Each of the vanes 14*b* to 14*d* divides the corresponding receiving chamber 50 in the housing 11 into a corresponding advance fluid chamber 52, 53, 54 and a corresponding retard fluid chamber 56, 57, 58 that are arranged in the circumferential direction. Specifically, the advance fluid chamber 52 is defined between the shoe 12*b* and the vane 14*b*, the advance fluid chamber 53 is defined between the shoe 12*c* and the vane 14*c*, and the advance fluid chamber 54 is defined between the shoe 12*d* and the vane 14*d*. Also, the retard fluid chamber 56 is defined between the shoe 12*c* and the vane 14*b*, the retard fluid chamber 57 is defined between the shoe 12*d* and the vane 14*c*, and the retard fluid chamber 58 is defined between the shoe 12*b* and the vane 14*d*.

In the above drive unit 10, a rotational phase of the vane rotor 14 relative to the housing 11 is changed in an advance direction by introducing hydraulic oil into the advance fluid chambers 52 to 54 and by draining hydraulic oil from the retard fluid chambers 56 to 58. Accordingly, the valve timing is advanced. In contrast, the rotational phase is changed in a retard direction by introducing hydraulic oil into the retard fluid chambers 56 to 58 and also by draining hydraulic oil from the advance fluid chambers 52 to 54. Accordingly, the valve timing is retarded.

(Control Unit)

In the control unit 30, As shown in FIG. 1, an advance passage 72 is provided to extend through the camshaft 3 and a bearing (not shown) that journals the camshaft 3. The advance passage 72 is always communicated with the advance fluid chambers 52 to 54 regardless of the change or the state of the rotational phase. Also, a retard passage 74 is provided to extend through the camshaft 3 and the bearing, and is always communicated with the retard fluid chambers 56 to 58 regardless of the change of the rotational phase.

A supply passage 76 is communicated with a discharge port of the pump 4, and hydraulic oil is suctioned from an oil pan 5 into an inlet port of the pump 4. The suctioned hydraulic oil is discharged through the discharge port of the pump 4. The pump 4 of the present embodiment is a mechanical pump driven by the crankshaft and discharges hydraulic oil to the supply passage 76 during the operation of the internal combustion engine 2. The operation of the internal combustion engine 2 includes the starting of the engine 2. Also, a drain passage 78 is provided to drain hydraulic oil to the oil pan 5.

A phase control valve 80 is mechanically connected to the advance passage 72, the retard passage 74, the supply passage 76, and the drain passage 78. The phase control valve 80 has a solenoid 82 and operates based on the energization to the solenoid 82 such that the phase control valve 80 switches communication state of (a) the advance passage 72 and the retard passage 74 with (b) the supply passage 76 and the drain passage 78.

A control circuit 90 is mainly made of a microcomputer, and is electrically connected with the solenoid 82 of the phase control valve 80. The control circuit 90 controls energization to the solenoid 82 and also controls the operation of the internal combustion engine.

In the above control unit 30, during the operation of the internal combustion engine 2, the phase control valve 80 operates in accordance with the energization to the solenoid 82 controlled by the control circuit 90 in order to change the communication state between (a) the advance passage 72 and the retard passage 74 and (b) the supply passage 76 and the drain passage 78. In the above, when the phase control valve 80 communicates the advance passage 72 with the supply passage 76 and communicates the retard passage 74 with the drain passage 78, hydraulic oil from the pump 4 is introduced to the advance fluid chambers 52 to 54 through the passages 76, 72. Also, hydraulic oil in the retard fluid chambers 56 to 58 is drained to the oil pan 5 through passages 74, 78. As a result, the valve timing is advanced. In contrast, when the phase control valve 80 communicates the retard passage 74 with the supply passage 76 and communicates the advance passage 72 with the drain passage 78, hydraulic oil from the pump 4 is introduced into the retard fluid chambers 56 to 58 through passages 76, 74, and hydraulic oil in the advance fluid chambers 52 to 54 is drained to the oil pan 5 through the passages 72, 78. Accordingly, the valve timing is retarded.

(Characteristic Configuration)

A characteristic configuration of the valve timing adjusting apparatus 1 will be described below.

(Operational Structure of Torque Variation)

Figure 3:
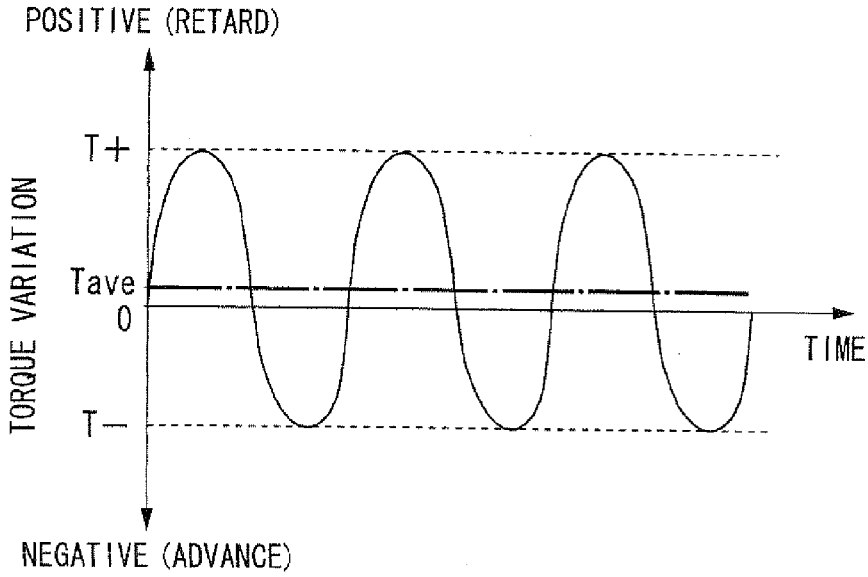
FIG. 3 is a schematic diagram for explaining variation of torque that is received by a drive unit shown in FIG. 1.

Torque variations or torque reversals are caused due to a spring reaction force of a valve spring of the intake valve that is opened and closed by the camshaft 2. Because the vane rotor 14 is connected coaxially with the camshaft 3 in the drive unit 10, the force caused by the torque variation is applied to the vane rotor 14 during the operation of the internal combustion engine 2. As shown in FIG. 3S the torque alternately changes or torque variations alternately change between a negative torque and a positive torque. When the negative torque is applied to the vane rotor 14 through the camshaft 2, the rotational phase of the vane rotor 14 relative to the housing 11 is biased in the advance direction. When the positive torque is applied to the vane rotor 14 through the camshaft 2, the rotational phase is biased in the retard direction. Specifically, the torque variations of the present embodiment are likely to have a peak torque T+ of the positive torque greater than an absolute value of a peak torque T− of the negative torque due to friction between the camshaft 2 and the bearing. As a result, the torque variations have an average torque $T_{ave}$ that biases the vane rotor 14 toward the positive torque. In other words, the average torque $T_{ave}$ biases the rotational phase of the vane rotor 14 relative to the housing 11 in the retard direction in average. Thus, the vane rotor 14 receives torque from the camshaft 3 in the retard direction in average.

(Operational Structure of Urging Torque)

Figure 4:
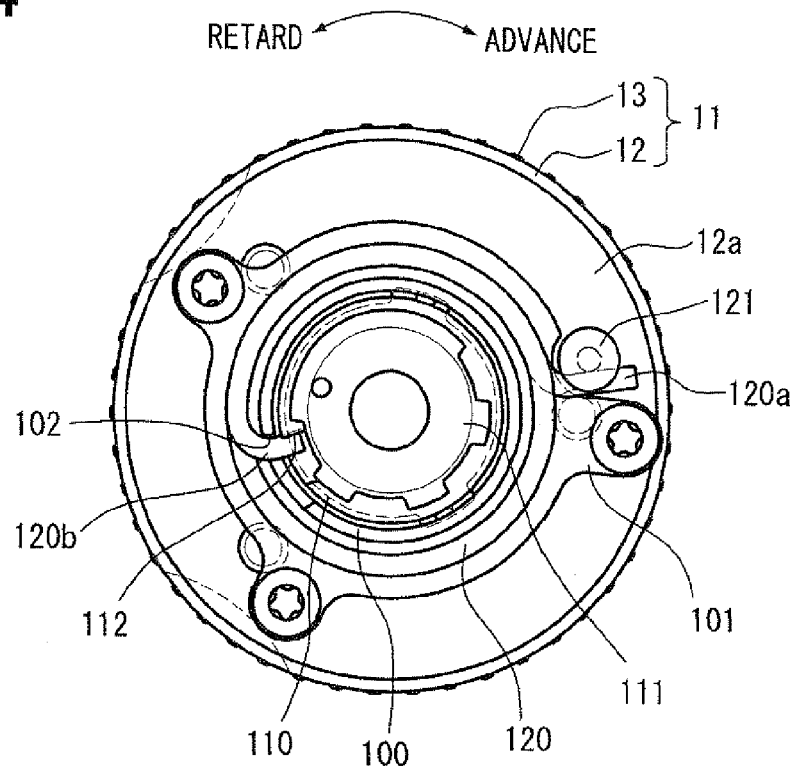
FIG. 4 is a view observed in direction IV-IV in FIG. 1.

As shown in FIGS. 1 and 4, the tubular portion 12*a* of the shoe member 12 of the housing 11 is coaxially fixed with a housing bush 100 through a flange wall 101 of the housing bush 100. The housing bush 100 is made of metal and is a hollow cylinder. The housing bush 100 has an end portion positioned opposite from the flange wall 101 in the longitudinal direction of the housing bush 100, and the end portion defines an arcuate housing groove 102, which that extends in the circumferential direction, and which is made by cutting part of the end portion in a radial direction.

A rotor bush 110 is made of metal and is a hollow cylinder having a bottom wall 111. The bottom wall 111 of the rotor bush 110 is coaxially fixed to the hub portion 14*a* of the vane rotor 14. The rotor bush 110 has a diameter smaller than a diameter of the housing bush 100, and thereby the rotor bush 110 is coaxially received within the housing bush 100 rotatably relative to the housing bush 100. The rotor bush 110 has an end portion positioned opposite from the bottom wall 111 in the longitudinal direction of the rotor bush 110. The end portion defines therein an arcuate rotor groove 112, which extends in the circumferential direction, and which is made by cutting part of the end portion in the radial direction.

An urging member 120 is provided coaxially at a position radially outward of the housing bush 100 and is made of a metal helical torsion spring. The tubular portion 12*a* of the shoe member 12 has an engagement pin 121 that is fixed thereto. The urging member 120 has one end portion 120*a* that is always engaged with the engagement pin 121 of the tubular portion 12*a*. The urging member 120 has the other end portion 120*b* that passes through the housing groove 102 and the rotor groove 112 in a radially inward direction. The other end portion 120*b* is loosely fitted with the housing groove 102 and the rotor groove 112.

Figure 5:
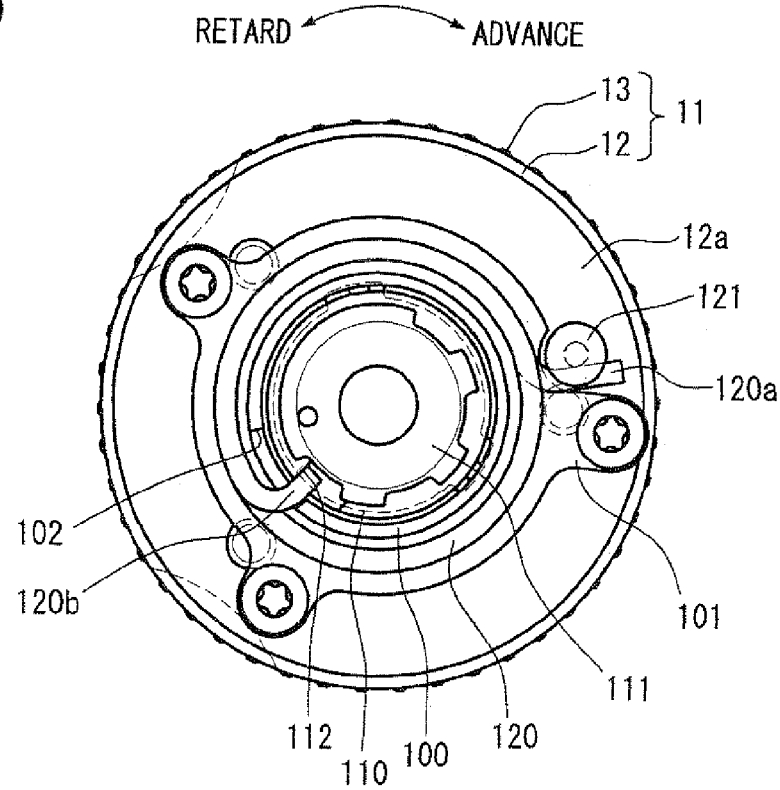
FIG. 5 is a view illustrating an operational state different from that in FIG. 4.

In the present embodiment, when the rotational phase is positioned between (a) a full retard phase shown in FIG. 5 and (b) a certain lock phase shown in FIG. 4, the other end portion 120*b* of the urging member 120 is engaged with an advance end of the rotor groove 112. In contrast, the other end portion 120*b* of the urging member 120 is not engaged with the housing groove 102 at the above state. During the operation of the internal combustion engine 2, the urging member 120 applies restoring force generated when twisted to the rotor groove 112 of the rotor bush 110 in the advance direction against the average torque $T_{ave}$ of the torque variations. Accordingly, the rotor bush 110 is urged in the advance direction of the rotational phase together with the vane rotor 14.

Figure 6:
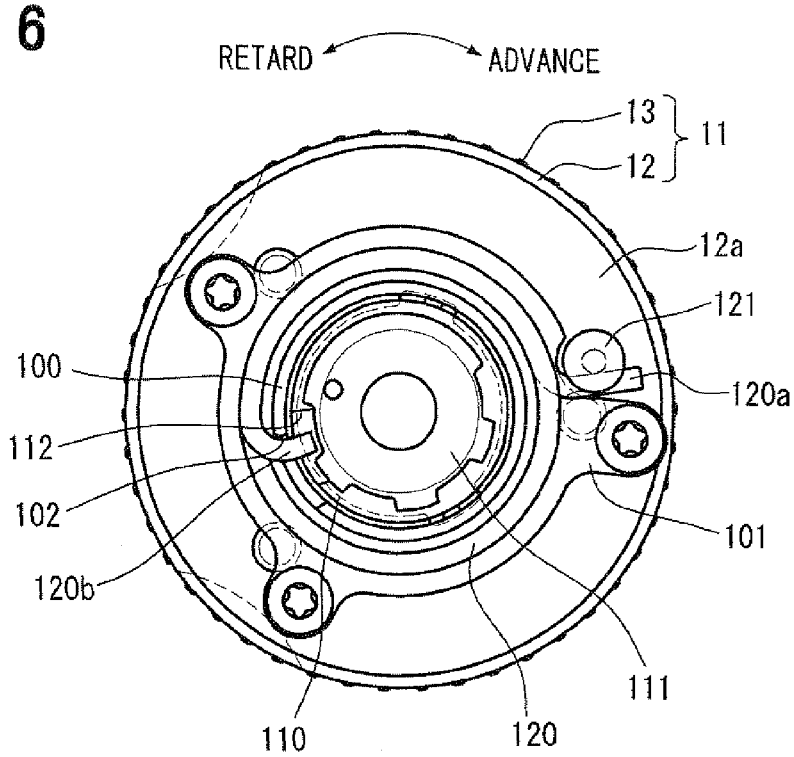
FIG. 6 is a view illustrating an operational state different from those in FIGS. 4 and 5.

In contrast, when the rotational phase is positioned between (a) the lock phase shown in FIG. 4 and (b) a full advance phase shown in FIG. 6, the other end portion 120*b* of the urging member 120 is engaged with an advance end of the housing groove 102. Thus, the other end portion 120*b* of the urging member 120 is not engaged with the rotor groove 112 in the above state. As a result, the urging member 120 exerts the restoring force only to the housing groove 102 of the housing bush 100. Thus, in the present embodiment, the vane rotor 14 is urged in the advance direction when the rotational phase of the vane rotor 14 is positioned on a retard side of the lock phase or is further retarded from the lock phase. However, the vane rotor 14 is not urged in the advance direction when the rotational phase of the vane rotor 14 is on an advance side of the lock phase or is further advanced from the lock phase.

It should be noted that in the internal combustion engine 2 of the present embodiment, to which the valve timing adjusting apparatus 1 is applied, a start phase region serves as a region or a range of the rotational phase that allows the engine 2 to start. More specifically, the start phase region is defined from an intermediate phase to a full advance phase such that the intake air is sufficiently supplied to the cylinder at the starting of the engine by the earlier opening of the intake valve. The intermediate phase ranges somewhere between the full retard phase and the full advance phase. The lock phase of the present embodiment is defined at a phase within the start phase region, in which the optimized engine startability is reliably achieved regardless of the change of the ambient temperature.

(Regulation/Lock Structure)

Figure 7:
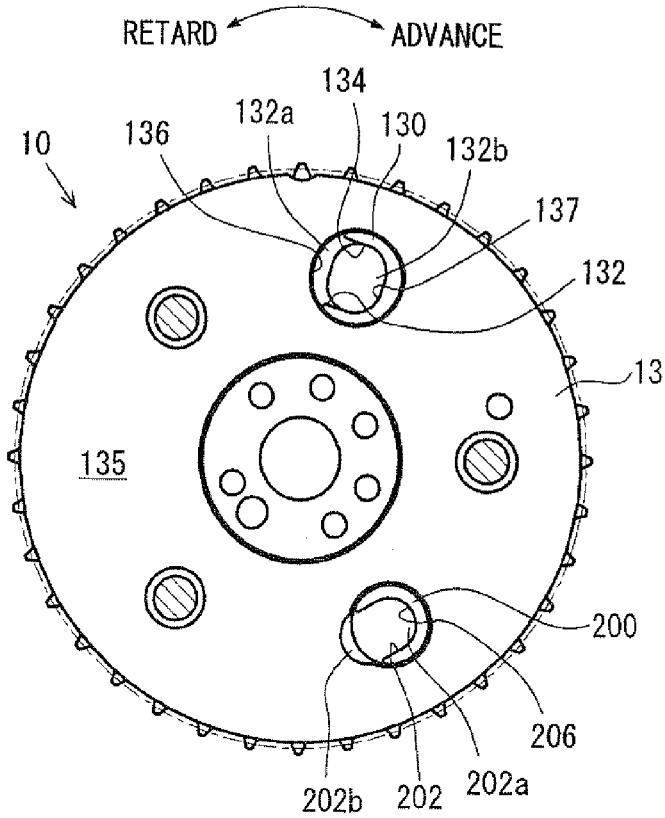
FIG. 7 is a cross-sectional view taken along line VII-VII in FIG. 1.

As shown in FIGS. 1 and 7, a guide 130 is made of metal and is fitted and fixed to the sprocket member 13 of the housing 11. The guide 130 has an inner peripheral surface that defines a first regulation groove 132 and a lock hole 134. The first regulation groove 132 opens at an inner surface 135 of the sprocket member 13 facing toward the vane rotor 14 and extends in the circumferential direction of the housing 11 to have an elongated hole shape. The first regulation groove 132 has opposite closed end portions 132*a*, 132*b* in the circumferential direction, and the end portions 132*a*, 132*b* are provided with a pair of first regulation stoppers 136, 137. The lock hole 134 is a hollow cylinder with a bottom and extends in an axial direction of the camshaft 3. The lock hole 134 opens to a bottom surface of the first regulation groove 132 at the other end portion 132*b* located on an advance side of the one end portion 132*a*. In other words, the other end portion 132*b* is located away from the one end portion 132*a* in the advance direction of the rotational phase.

As shown in FIGS. 1 and 2, a sleeve 140 that is made of metal is fitted and fixed to the vane 14*b* of the vane rotor 14. The sleeve 140 has an inner peripheral surface that has a stepped cylindrical surface shape and that extends in parallel with a longitudinal direction of the hub portion 14*a*. More specifically, the inner peripheral surface of the sleeve 140 defines a small-diameter hole 142 and a large-diameter hole 144. The small-diameter hole 142 has a diameter smaller than a diameter of the large-diameter hole 144 and is positioned away from the large-diameter hole 144 toward the sprocket member 13. The small-diameter hole 142 opens to the inner surface 135 of the sprocket member 13. Accordingly, due to the above configuration, the small-diameter hole 142 is opposed to the first regulation groove 132, which extends in the circumferential direction (rotational direction) of the vane rotor 14 when the rotational phase is within a certain rotational phase region. The large-diameter hole 144 is communicated with a first regulation passage 146 that extends through the sleeve 140 and the vane rotor 14.

The sleeve 140 supports a first regulation pin 150 made of metal. As shown in FIG. 1, the first regulation pin 150 has an outer peripheral surface having a stepped cylindrical surface shape such that the outer peripheral surface forms a main body portion 152 and a force receiver 156. The main body portion 152 is coaxially received within the small-diameter hole 142 of the sleeve 140 and is displaceable in a longitudinal direction. The force receiver 156 is coaxially received within the large-diameter hole 144 of the sleeve 140 and is displaceable in the longitudinal direction. The force receiver 156 has an end surface facing toward the sprocket member 13, and the end surface of the force receiver 156 receives pressure of hydraulic oil that is introduced to the large-diameter hole 144 through the first regulation passage 146. The application of the pressure generates first regulation driving force that drives the first regulation pin 150 in a direction away from the sprocket member 13.

As shown in FIGS. 1 and 2, a first regulation resilient member 170 is made of a metal compression coil spring and is provided within the large-diameter hole 144 of the sleeve 140 between the vane 14*b* of the vane rotor 14 and the first regulation pin 150. The first regulation resilient member 170 applies restoring force, which is generated when compressed, to the first regulation pin 150, and thereby the first regulation resilient member 170 urges the pin 150 toward the sprocket member 13.

Operation of the first regulation pin 150 and the second regulation pin 220 will be described with reference to FIGS. 8A to 8L. More specifically, FIGS. 8A and 8B are cross section schematic diagrams of the valve timing adjusting apparatus taken along lines VIIIA-VIIIA and VIIIB-VIIIB of FIG. 2, respectively, when a rotational phase corresponds to the full retard phase. FIGS. 8C and 8D are cross section schematic diagrams of the valve timing adjusting apparatus when the rotational phase corresponds to a first regulation phase (described later). FIGS. 8E and 8F are cross section schematic diagrams of the valve timing adjusting apparatus when the rotational phase corresponds to a second regulation phase (described later). FIGS. 8G and 8H are cross section schematic diagrams of the valve timing adjusting apparatus when the rotational phase corresponds to the lock phase. FIGS. 8I and 8J are cross section schematic diagrams of the valve timing adjusting apparatus when the rotational phase corresponds to the lock phase. FIGS. 8K and 8L are cross section schematic diagrams of the valve timing adjusting apparatus when the rotational phase corresponds to the full advance phase. In FIGS. 8A to 8L, a left side corresponds to the retard side and a right side corresponds to the advance side. Note that FIG. 2 does not correspond to the full retard phase but schematically show where the cross sections of FIGS. 8A and 8B correspond to, FIGS. 8C, 8E, 8G, 8I, and 8K are cross sectional views taken along lines similar to those of FIG. 8A. Also, FIGS. 8D, 8F, 8H, 8J, and 8L cross sectional views taken along lines similar to those of FIG. 8B.

Due to the above configuration, the main body portion 152 of the first regulation pin 150 is inserted into the first regulation groove 132 of the housing 11 and is circumferentially movable within the first regulation groove 132 as shown in FIGS. 8C to 8L. Thus, the main body portion 152 is engageable with each of the first regulation stoppers 136, 137. As shown in FIGS. 8C and 8D, when the main body portion 152 is engaged with the first regulation stopper 136 that is located on the retard side of the first regulation stopper 137, change of the rotational phase in the retard direction is regulated to a first regulation phase that is an end of the start phase region in the retard direction. The first regulation phase is positioned between the full retard phase and the lock phase. In contrast, as shown in FIGS. 8G and 8H, when the main body portion 152 is engaged with the first regulation stopper 137 that is located on the advance side of the first regulation stopper 136, the change of the rotational phase in the advance direction is regulated to the lock phase. As above, because the main body portion 152 is engaged with each of the first regulation stoppers 136, 137, the rotational phase is regulated within a predetermined phase region Wp1 positioned within the start phase region (see FIGS. 8G and 8H).

Also, the main body portion 152 of the first regulation pin 150 is inserted into the lock hole 134 of the housing 11 via the first regulation groove 132 as schematically shown in FIGS. 8I and 8J, and is coaxially fittable into the hole 134. As a result, by fitting the main body portion 152 into the lock hole 134, the rotational phase is locked. Thus, change of the rotational phase in the advance and retard directions is regulated to the lock phase within the start phase region.

Further, the main body portion 152 of the first regulation pin 150 is capable of getting out of both the lock hole 134 and the first regulation groove 132 of the housing 11 against the restoring force of the first regulation resilient member 170 as schematically shown in FIGS. 8A and 8K. As a result, because the main body portion 152 is capable of getting out of or being disengaged from the lock hole 134 and the first regulation groove 132, the rotational phase is changeable to any phase state or to any angular position.

As shown in FIGS. 1 and 7, the sprocket member 13 of the housing 11 is fitted and fixed with a metal guide 200. The guide 200 has an inner peripheral surface that defines a second regulation groove 202. The second regulation groove 202 extends in a circumferential direction of the housing 11 and has an elongated hole that opens to the inner surface 135 of the sprocket member 13. The second regulation groove 202 has closed end portions 202*a*, 202*b*, and one end portion 202*a* is located on a side of the other end portion 202*b* in the retard direction of the rotational phase. A second regulation stopper 206 is formed at the one end portion 202*a*.

As shown in FIGS. 1 and 2, the vane 14*c* of the vane rotor 14 is fitted and fixed with a metal sleeve 210. The sleeve 210 has an inner peripheral surface having a stepped cylindrical surface shape that extends in the longitudinal direction of the hub portion 14*a*. The inner peripheral surface defines a small-diameter hole 212 and a large-diameter hole 214. The small-diameter hole 212 has a diameter smaller than a diameter of the large-diameter hole 214, and is positioned away from the large-diameter hole 214 toward the sprocket member 13. Also, the small-diameter hole 212 opens to the inner surface 135 of the sprocket member 13. Due to the above configuration, the small-diameter hole 212 is opposed to the second regulation groove 202, which extends in the circumferential direction of the vane rotor 14, over a predetermined rotational phase region. The large-diameter hole 214 is communicated with a second regulation passage 216 that extends through the sleeve 210 and the vane rotor 14.

The sleeve 210 supports a metal second regulation pin 220. As shown in FIG. 1, the second regulation pin 220 has an outer peripheral surface having a stepped cylindrical surface shape, and the outer peripheral surface defines a main body portion 222 and a force receiver 226. The main body portion 222 is coaxially received within the small-diameter hole 212 of the sleeve 210 and is displaceable in the longitudinal direction. The force receiver 226 is coaxially received within the large-diameter hole 214 of the sleeve 210 and is displaceable in the longitudinal direction. The force receiver 226 has an end surface facing toward the sprocket member 13, and the end surface of the force receiver 226 receives pressure of hydraulic oil that is introduced into the large-diameter hole 214 through the second regulation passage 216. The application of pressure generates a second regulation driving force that drives the second regulation pin 220 in a direction away from the sprocket member 13.

As shown in FIGS. 1 and 2, the large-diameter hole 214 of the sleeve 210 coaxially receives therein a second regulation resilient member 230 between the vane 14*c* of the vane rotor 14 and the second regulation pin 220, and the second regulation resilient member 230 is made of a metal compression coil spring. The second regulation resilient member 230 applies restoring force generated when compressed to the second regulation pin 220 such that the second regulation resilient member 230 urges the pin 220 toward the sprocket member 13.

Due to the above configuration, the main body portion 222 of the second regulation pin 220 is inserted into the second regulation groove 202 of the housing 11 as schematically shown in FIGS. 8E to 8L, and is movable within the second regulation groove 202. Also, the main body portion 222 is engageable with the second regulation stopper 206. As shown in FIGS. 8E and 8F, when the main body portion 222 is engaged with the second regulation stopper 206 that is located on the end of the second regulation groove 202 in the retard direction, the change of the rotational phase in the retard direction is regulated to a second regulation phase. For example, The second regulation phase is within the start phase region and is located on the advance side of the first regulation phase. Also, the second regulation phase is defined between the full retard phase and the lock phase. Also, as shown in FIGS. 8G and 8H, when the main body portion 152 of the first regulation pin 150 is engaged with the first regulation stopper 137 that is located on the end of the first regulation groove 132 in the advance direction in a state, where the main body portion 222 is inserted into the second regulation groove 202 of the housing 11, the change of the rotational phase is regulated to the lock phase. Because the main body portions 222, 152 are engaged with the regulation stoppers 206, 137, respectively, as above, the rotational phase is limited within a phase region Wp2 of the start phase region (see FIGS. 8G and 8H). The phase region Wp2 is narrower than the phase region Wp1.

Furthermore, the main body portion 222 of the second regulation pin 220 is capable of getting out of the second regulation groove 202 of the housing 11 against the restoring force of the second regulation resilient member 230 as schematically shown in FIGS. 8A to 8D. As a result, when the main body portion 152 of the first regulation pin 150 gets out of or is disengaged from the first regulation groove 132 in a state, where the main body portion 222 stays out of the second regulation groove 202, the rotational phase is changeable to any phase state or to any angular position.

(Fluid Circuit Opening-Closing Structure)

Figure 9:
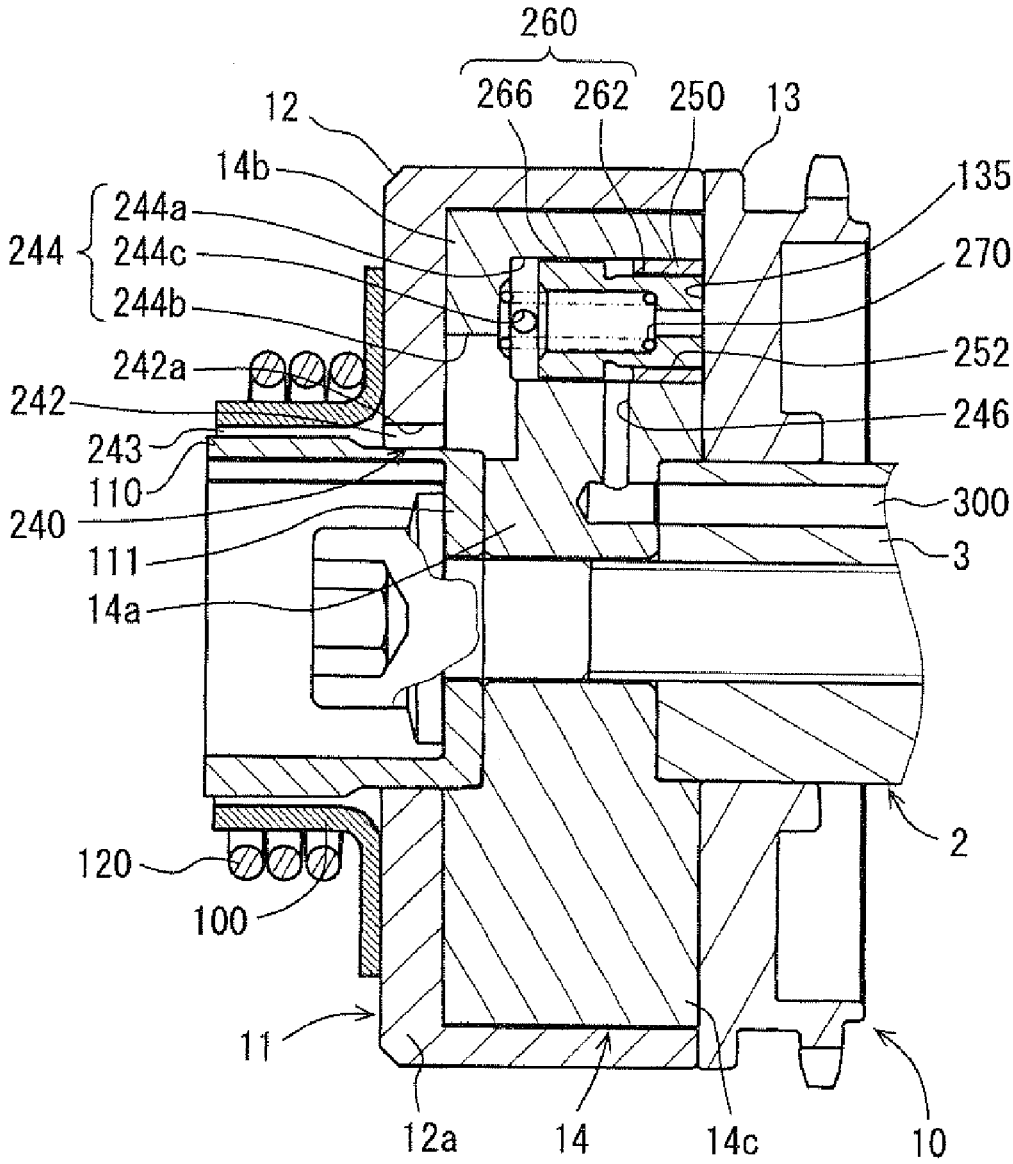
FIG. 9 is a cross-sectional view taken along line of IX-IX in FIG. 2.

As shown in FIG. 9, the shoe member 12 of the housing 11 and the vane rotor 14 define a fluid path arrangement 240 that extends from the shoe member 12 to the vane rotor 14. The fluid path arrangement 240 includes a first fluid passage 242 and a second fluid passage 244.

The shoe member 12 includes a central hole 242*a* that extends through a bottom wall the tubular portion 12*a* of the shoe member 12 in the longitudinal direction and that has a cylindrical hole. The first fluid passage 242 is defined between the radially inner surface of the central hole 242*a* and the radially outer surface of the rotor bush 110 and has an annular shape or an arcuate shape, for example. Due to the above structure, the first fluid passage 242 extends through the housing 11 such that the first fluid passage 242 connects exterior of the housing 11 with interior of the housing 11. The first fluid passage 242 opens to air outside the housing 11 or opens to atmosphere through an annular clearance 243 defined between the rotor bush 110 and housing bush 100.

As shown in FIGS. 2 and 9, the second fluid passage 244 provides communication between the first fluid passage 242 and the advance fluid chamber 52 in the vane rotor 14. More specifically, the second fluid passage 244 includes a receiver hole 244*a*, a connection groove 244*b* and a restrictor hole 244*c* as shown in FIG. 9.

The receiver hole 244*a* has a cylindrical surface hole shape that extends in the longitudinal direction of the hub portion 14*a*, is provided to the vane 14*b* such that the receiver hole 244*a* opens to the inner surface 135 of the sprocket member 13. Also, the receiver hole 244*a* is communicated with an opening-closing control passage 246 at a longitudinal middle part of the receiver hole 244*a*. The opening-closing control passage 246 extends through the vane rotor 14.

As shown in FIG. 9, the connection groove 244*b* is provided to the vane 14*b* and the hub portion 14*a* and extends between the rotor bush 110 and the receiver hole 244*a*. Due to the above configuration, the connection groove 244*b* is always communicated with the first fluid passage 242 that extends in the circumferential direction along the outer peripheral side of the rotor bush 110 regardless of the change of the rotational phase. The connection groove 244*b* is also communicated with an end portion of the receiver hole 244*a* opposite from the sprocket member 13.

As shown in FIGS. 2 and 9, the restrictor hole 244*c* is a cylindrical hole and has a cross sectional area smaller than a cross sectional area of the connection groove 244*b*. The restrictor hole 244*c* is provided to the vane 14*b* and is communicated with the end portion of the receiver hole 244*a* opposite from the sprocket member 13. Due to the above configuration, the restrictor hole 244*c* serves as a "restrictor member" that reduces an area of a passage of the second fluid passage 244, through which fluid flows between the receiver hole 244*a* and the advance fluid chamber 52, for example. Also, the restrictor hole 244*c* is always communicated with the advance fluid chamber 52 regardless of the change of the rotational phase. In the present embodiment, the advance fluid chamber 52 serves as a "specific fluid chamber", a volume of which is increased when the rotational phase is changed in the advance direction.

As shown in FIG. 9, the receiver hole 244*a* of the second fluid passage 244 of the fluid path arrangement 240 is fitted and fixed to a metal sleeve 250. The sleeve 250 has an inner peripheral surface having a cylindrical surface shape that extends in the longitudinal direction of the hub portion 14*a*, and the inner peripheral surface defines a small-diameter hole 252 having a diameter smaller than a diameter of the receiver hole 244*a*. The small-diameter hole 252 is positioned on a side of the receiver hole 244*a* adjacently to the sprocket member 13. Due to the above configuration, the small-diameter hole 252 is located on a side of the longitudinal middle part of the receiver hole 244*a* toward the sprocket member 13. The receiver hole 244*a* is connected with the opening-closing control passage 246 at the longitudinal middle part of the receiver hole 244*a*. Also, the small-diameter hole 252 opens toward the inner surface 135 of the sprocket member 13.

As shown in FIGS. 2 and 9, the receiver hole 244*a* of the second fluid passage 244 and the small-diameter hole 252 of the sleeve 250 support a metal opening-closing pin 260. As shown in FIG. 9, the opening-closing pin 260 has an outer peripheral surface having a stepped cylindrical surface shape that is reduced stepwise in diameter toward the end portion. More specifically, the outer peripheral surface defines a main body portion 262 and a force receiver 266. The main body portion 262 is coaxially received in the small-diameter hole 252 and is displaceable in the longitudinal direction. The force receiver 266 is coaxially received in the receiver hole 244*a* and is displaceable in the longitudinal direction. The force receiver 266 has an end surface facing toward the sprocket member 13, and the end surface of the force receiver 266 receives pressure of hydraulic oil supplied into the receiver hole 244*a* through the opening-closing control passage 246. The application of pressure generates opening-closing driving force that drives the opening-closing pin 260 in a direction away from the sprocket member 13.

As shown in FIGS. 2 and 9, an opening-closing resilient member 270 is received coaxially in the receiver hole 244*a* of the second fluid passage 244 between the vane 14*b* of the vane rotor 14 and the opening-closing pin 260, and the opening-closing resilient member 270 is made of a metal compression coil spring. The opening-closing resilient member 270 applies restoring force, which is generated when compressed, to the opening-closing pin 260 such that the opening-closing resilient member 270 urges the pin 260 toward the sprocket member 13.

Figure 10:
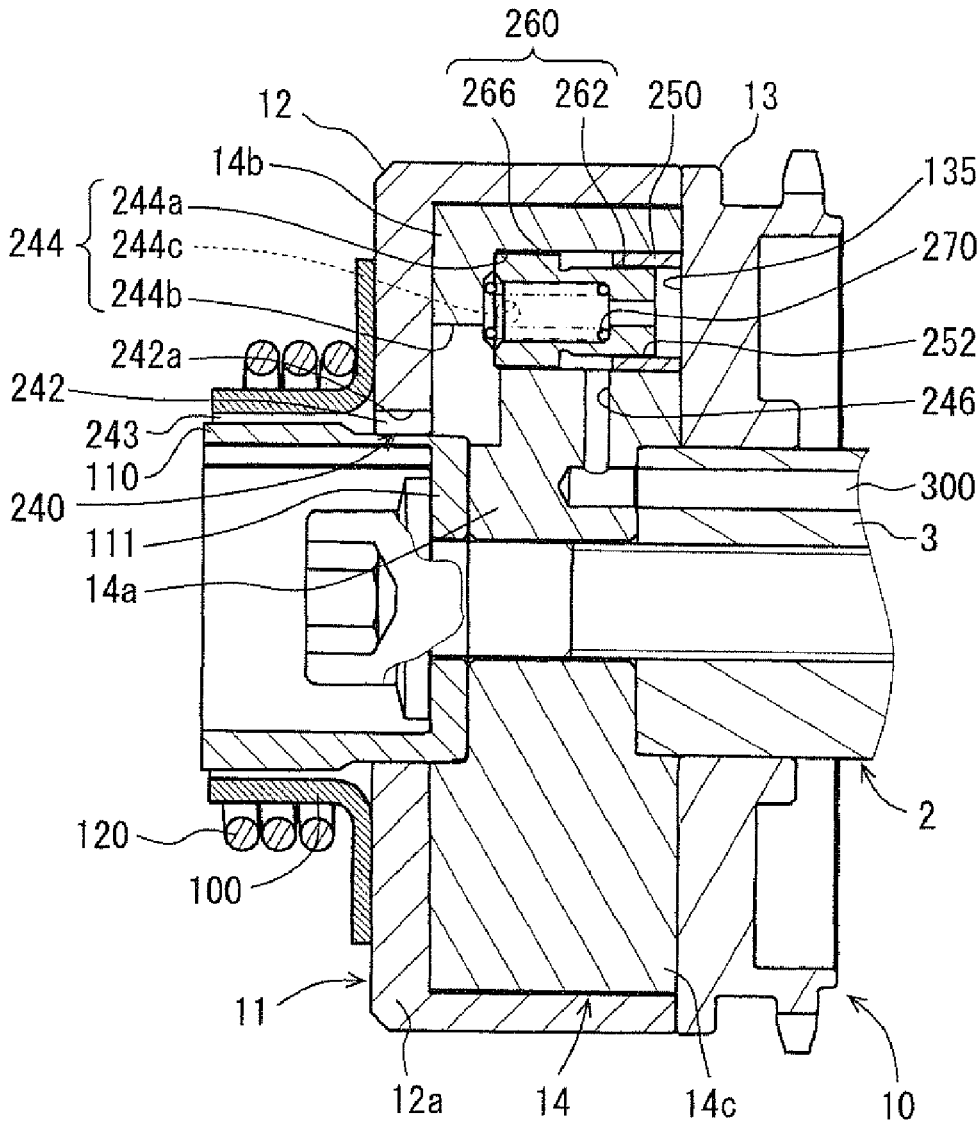
FIG. 10 is a cross-sectional view illustrating an operational state different from that in FIG. 9.

Because of the above configuration, by displacing the opening-closing pin 260 to an opening position shown in FIG. 9, the opening-closing pin 260 is brought in contact with the inner surface 135 of the sprocket member 13 and is spaced apart from the bottom end of the receiver hole 244*a*. As a result, the connection between the receiver hole 244*a* and the restrictor hole 244*c* becomes uncovered by the opening-closing pin 260 or becomes exposed to the connection groove 244*b*, and thereby the second fluid passage 244 of the fluid path arrangement 240 is opened. In contrast, by displacing the opening-closing pin 260 to a closed position shown in FIG. 10, the opening-closing pin 260 is spaced apart from the inner surface 135 of the sprocket member 13 or is brought into contact with the bottom end of the receiver hole 244*a*. As a result, the connection between the receiver hole 244*a* and the restrictor hole 244*c* is covered by the opening-closing pin 260 or is closed, and thereby the second fluid passage 244 of the fluid path arrangement 240 is closed.

(Driving Force Control)

As shown in FIGS. 1 and 9, the control unit 30 has a drive passage 300 that extends through the camshaft 3 and the bearing that journals the camshaft 3. The drive passage 300 is always communicated with the passages 146, 216, 246 regardless of the change of the rotational phase. Also, as shown in FIG. 1, the control unit 30 has a branch passage 302 that branches from the supply passage 76. The branch passage 302 is supplied with hydraulic oil from the pump 4 through the supply passage 76. Furthermore, the control unit 30 has a drain passage 304 is configured to drain hydraulic oil to the oil pan 5.

A drive control valve 310 is mechanically connected with the drive passage 300, the branch passage 302, and the drain passage 304. The drive control valve 310 operates based on the energization to a solenoid 312 that is electrically connected with the control circuit 90 in order to switch a communication state between (a) the drive passage 300 and (b) one of the branch passage 302 and the drain passage 304.

When the drive control valve 310 communicates the branch passage 302 with the drive passage 300, hydraulic oil from the pump 4 is introduced to the holes 144, 214, 244*a* that receive therein the pins 150, 220, 260, respectively, through the passages 76, 302, 300, 146, 216, 246. As a result, in the above case, driving force is generated to drive each of the pins 150, 220, 260 against the restoring force of the resilient members 170, 230, 270. In contrast, when the drive control valve 310 communicates the drain passage 304 with the drive passage 300, hydraulic oil in the holes 144, 214, 244*a* is drained to the oil pan 5 through the passages 146, 216, 246, 300, 304. As a result, in the above case, the driving force that drives each of the pins 150, 220, 260 is not generated or removed.

(Characteristic Operation)

Characteristic operations of the valve timing adjusting apparatus 1 will be described in detail.

(Normal Operation)

Firstly, there is explained a normal operation, in which the internal combustion engine 2 normally stops. Three cases (I), (II), and (III) of the normal operation will be described below.

Case (I): During a normal stop, in which the internal combustion engine 2 is normally stopped in accordance with a stop command, such as OFF command, of the ignition switch, the control circuit 90 controls the energization to the phase control valve 80 in order to cause the phase control valve 80 to communicate the supply passage 76 with the advance passage 72. In general, when the engine 2 is stopping, the internal combustion engine 2 keeps rotating by inertia until the internal combustion engine 2 completely stops. In the above, because the rotational speed of the internal combustion engine 2 is reduced, pressure of hydraulic oil, which is to be supplied from the pump 4 into the advance fluid chambers 52 to 54 through the passages 76, 72, is also reduced. Accordingly, because pressure of oil introduced to the advance fluid chambers 52 to 54 is reduced as the reduction of rotational speed of the engine 2, force applied to the vane rotor 14 is also reduced. More specifically, when the rotational phase is within the rotational phase region located on the retard side of the lock phase, the restoring force of the urging member 120 that urges the vane rotor 14 becomes more dominant.

Also, during the normal stop of the internal combustion engine 2 in accordance with the stop command, the control circuit 90 controls the energization of the drive control valve 310 in order to cause the drive control valve 310 to communicate the drain passage 304 with the drive passage 300. As a result, hydraulic oil in the holes 144, 214, 244*a* is drained through the passages 300, 304, and thereby the driving force that drives each of the pins 150, 220, 260 is removed. Accordingly, the restoring force of the resilient members 170, 230, 270 that urge the pins 150, 220, 260 becomes dominant. In other words, the pins 150, 220, 260 are urged mainly by the restoring force of the resilient members 170, 230, 270.

In the present embodiment, the rotational phase is locked to the lock phase as above differently with the different state of the rotational phase at the time of issuance of the stop command. In the present embodiment, for example, the case (I) includes four different cases (I-1), (I-2), (I-3), (I-4) as described below.

Case (I-1): When the rotational phase at the time of issuance of the stop command indicates the full retard phase shown in FIGS. 8A and 8B, the vane rotor 14 is urged by the urging member 120 and rotates relative to the housing 11. Thus, the rotational phase is changed in an urging direction, in which the urging member 120 urges the vane rotor 14. In other words, the rotational phase is changed in the advance direction. When the rotational phase reaches the first regulation phase shown in FIGS. 8C and 8D due to the phase change in the advance direction, the main body portion 152 of the first regulation pin 150 urged by the first regulation resilient member 170 is pushed into the first regulation groove 132. As a result, the rotational phase is limited within the phase region Wp1, which includes the lock phase, within the start phase region. Furthermore, when the rotational phase reaches a second regulation phase shown in FIGS. 8E and 8F due to the phase change further in the advance direction, the main body portion 222 of the second regulation pin 220 urged by the second regulation resilient member 230 is pushed into the second regulation groove 202. As a result, the rotational phase is limited within the phase region Wp2, which also includes the lock phase, within the start phase region. The phase region Wp2 is narrower than the phase region Wp1.

Then, when the rotational phase reaches the lock phase shown in FIGS. 8G and 8H due to the phase change in the advance direction, the main body portion 152 of the first regulation pin 150 is engaged with the first regulation stopper 137 that is located on the advance side of the first regulation groove 132. The urging member 120 urges the first regulation pin 150 in the advance direction such that the first regulation pin 150 is pressed against the first regulation stopper 137, and the first regulation pin 150 is also urged in the longitudinal direction toward lock hole 134 the by the first regulation resilient member 170. As a result, the main body portion 152 is inserted and fitted into the lock hole 134 as shown in FIGS. 8I and 8J. Accordingly, the rotational phase is locked to the lock phase.

Case (I-2): For example, when the rotational phase is positioned in a range between the full retard phase and the lock phase or is positioned at the lock phase as shown in FIGS. 8C and 8H at the time of issuance of the stop command, the operation similar to the operation described in the above case (I-1) will be performed to the apparatus under the corresponding state, where the rotational phase is positioned at the corresponding phase at the time of issuance of the stop command. As a result, also in the above case, the rotational phase is effectively locked to the lock phase.

Case (I-3): When the rotational phase is positioned at the full advance phase shown in FIGS. 8K and 8L at the time of issuance of the stop command, the main body portion 222 of the second regulation pin 220 that is urged by the second regulation resilient member 230 is inserted into the second regulation groove 202. In the present embodiment, the application of urging force by the urging member 120 to the vane rotor 14 is limited as described above when the rotational phase is advanced further from the lock phase. Thus, in the above insertion state, because torque variation from the camshaft 3 of the internal combustion engine 2 that rotates by inertia is applied to the vane rotor 14 in the retard direction in average, the rotational phase is gradually changed in the retard direction. When rotational phase reaches the lock phase shown in FIGS. 8G and 8H due to the above phase change in the retard direction, the main body portion 152 of the first regulation pin 150 urged by the first regulation resilient member 170 is pushed into the first regulation groove 132 and the lock hole 134 sequentially. Accordingly, the rotational phase is locked to the lock phase.

Case (I-4): When the rotational phase is in a range between the full advance phase and the lock phase at the time of issuance of the stop command, the operation similar to the operation described in the above case (I-3) is performed to the apparatus under the corresponding state, where the rotational phase is positioned at the corresponding phase at the time of issuance of the stop command. As a result, in the above case, the rotational phase is also successfully locked to the lock phase.

Next, case (II) will be described. The case (II) shows an example case, where after the above normal stop has been operated, the engine 2 is started by cranking the engine 2 in accordance with a start command, such as ON command, of the ignition switch.

Case (II): When the internal combustion engine 2 is started by cranking the engine 2 in accordance with the start command after the normal stop, the control circuit 90 controls the energization to the phase control valve 80 in order to cause the phase control valve 80 to communicate with the supply passage 76 with the advance passage 72. As a result, hydraulic oil from the pump 4 is introduced into the advance fluid chambers 52 to 54 through the passages 76, 72. Also, at the time of starting the internal combustion engine 2 in accordance with the issuance of the start command after the normal stop, the control circuit 90 controls the energization to the drive control valve 310 in order to cause the drive control valve 310 to communicate the drain passage 304 with the drive passage 300. As a result, the introduction of hydraulic oil into the holes 144, 214, 244*a* is limited, and thereby the driving force for driving each of the pins 150, 220, 260 remains removed. Accordingly, the restoring force of the resilient members 170, 230, 270 that urge each of the pins 150, 220, 260 becomes more dominant.

Due to the above, the final state of the above operation described in the case (I) including cases (I-1), (I-2), (I-3), (I-4) is maintained. In other words, the first regulation pin 150 remains fitted into the lock hole 134 due to the restoring force of the first regulation resilient member 170 as shown in FIGS. 8I and 8J, and also the second regulation pin 220 remains inserted into the second regulation groove 202 due to the restoring force of the second regulation resilient member 230. More specifically, during the cranking of the engine 2 until the completion of the starting of the engine 2, pressure of hydraulic oil from the pump 4 remains low in general. For example, the starting of the engine 2 is completed when the engine 2 becomes self-sustaining. As a result, even when abnormality causes hydraulic oil to erroneously enter into the holes 144, 214, it is possible to maintain the first regulation pin 150 and the second regulation pin 220 inserted into the lock hole 134 and the second regulation groove 202, respectively. As a result, it is possible to lock the rotational phase to the lock phase that is appropriate to start the internal combustion engine 2, and thereby the engine startability is effectively achieved.

Next, case (III) will be described. The case (III) shows an example of the operation of the engine 2 after the starting of the engine 2 has been completed, or in other words, after the engine 2 has become self-sustaining.

Case (III): After the completion of the starting of the engine 2, the control circuit 90 controls the energization to the drive control valve 310 in order to cause the drive control valve 310 to communicate the branch passage 302 with the drive passage 300. As a result, hydraulic oil having increased pressure is introduced into the holes 144, 214, 244*a* through the passages 76, 302, 300, 146, 216, 246, and thereby the driving force for driving each of the pins 150, 220, 260 is generated.

As above, the first regulation pin 150 that receives the first regulation driving force is driven against the restoring force of the first regulation resilient member 170, and thereby the first regulation pin 150 gets out of the lock hole 134 and the first regulation groove 132. Also, the second regulation pin 220 that receives the second regulation driving force is driven against the restoring force of the second regulation resilient member 230, and thereby the second regulation pin 220 gets out of the second regulation groove 202. Furthermore, the opening-closing pin 260 receives the opening-closing driving force and is driven against the restoring force of the opening-closing resilient member 270, and thereby the opening-closing pin 260 is maintained at the closed position shown in FIG. 10. As a result, the fluid path arrangement 240 is kept closed, and thereby leakage of hydraulic oil from the advance fluid chamber 52 is reliably limited. Because the above operation makes it possible to change the rotational phase to any phase state, it is possible to appropriately adjust the valve timing when the control circuit 90 controls the energization to the phase control valve 80 in order to introduce hydraulic oil from the pump 4 into the advance fluid chambers 52 to 54 or into the retard fluid chambers 56 to 58.

(Fail-Safe Operation)

Next, a fail-safe operation executed in a case, where the engine 2 abnormally stops, will be described. In the present embodiment, three cases (i), (ii), (iii) will be described below for explaining the fail-safe operation.

Case (i): In an abnormal stop, the internal combustion engine 2 is instantly stopped and is locked due to the abnormal engagement of a clutch, for example. At the time of the abnormal stop, the energization to the phase control valve 80 from the control circuit 90 is cut, and thereby the supply passage 76 is communicated with the advance passage 72. In the above case, pressure of hydraulic oil, which is to be introduced from the pump 4 to the advance fluid chambers 52 to 54 through the passages 76, 72, is also sharply reduced, and thereby the vane rotor 14 does not receive force caused by pressure of the oil. Accordingly, the rotational phase is maintained at a state at the time of the abnormal stop (momentary stop) due to the lock of the internal combustion engine 2.

Also, at the time of the abnormal stop of the internal combustion engine 2, the energization to the drive control valve 310 from the control circuit 90 is cut, and thereby the drain passage 304 becomes communicated with the drive passage 300. As a result, the driving force for driving each of the pins 150, 220, 260 is removed, and thereby the restoring force of the resilient members 170, 230, 270 that urge each of the pins 150, 220, 260 becomes more dominant. In other words, the pins 150, 220, 260 are urged mainly by the restoring force of the resilient members 170, 230, 270.

As above, when the rotational phase at the time of the abnormal stop is different from the lock phase, it is impossible to fit the first regulation pin 150 into the lock hole 134, and thereby the internal combustion engine 2 waits for the next starting operation in a state, where the rotational phase is not locked to the lock phase. Exceptionally, in a case, where the rotational phase corresponds to the lock phase when the abnormal stop occurs, the restoring force of the first regulation resilient member 170 causes the first regulation pin 150 to be fitted into the lock hole 134. As a result, the internal combustion engine 2 waits for the next operation in a state, where the rotational phase is locked to the lock phase.

Next, case (ii) will be described below. The case (ii) shows an example, in which after the above abnormal stop, the engine 2 is started in accordance with the start command.

Case (ii): When the internal combustion engine 2 is started in accordance with the start command after the above abnormal stop, the control circuit 90 controls the energization to the phase control valve 80 in order to cause the phase control valve 80 to introduce hydraulic oil from the pump 4 into the advance fluid chambers 52 to 54. At the same time, the control circuit 90 controls the energization to the drive control valve 310 in order to continuously remove the driving force of the hydraulic oil for driving each of the pins 150, 220, 260.

Thereby, in the present embodiment, by the time of the completion of the starting of the internal combustion engine 2, the rotational phase becomes adjusted within the start phase region in a different manner correspondingly to the state of the rotational phase at the time of issuance of the start command as shown below. It should be noted that in a certain case, where the rotational phase at the time of the issuance of the start command corresponds to the lock phase, the rotational phase has been locked to the lock phase when the start command is issued or given. Thereby, this means that the operation similar to the normal operation described in the above case (II) is performed. Thus, the explanation of the above certain case is omitted.

The case (ii) includes cases (ii-1), (ii-2), (ii-3) as described below.

Case (i-1): When the rotational phase at the time of issuance of the start command is substantially out of the start phase region and corresponds to the full retard phase shown in FIGS. 8A and 8B, the restoring force of the opening-closing resilient member 270 causes the opening-closing pin 260 to be located at the opening position shown in FIG. 9. Thus, the fluid path arrangement 240 is opened, and thereby the advance fluid chamber 52 is communicated with the exterior of the housing 11 through the fluid path arrangement 240. In the above situation, the introduction of hydraulic oil to the advance fluid chambers 52 to 54 and the urging force of the urging member 120 cause each of the regulation pins 150, 220 to be inserted into the corresponding regulation groove 132, 202 and change the rotational phase in the advance direction in a manner described in the operation shown in the case (I-1).

During the above phase change in the advance direction, the volume of the advance fluid chamber 52 is increased by the negative torque of the torque variation applied in the advance direction. In the above state, atmosphere outside the housing 11 is introduced into the advance fluid chamber 52 through the fluid path arrangement 240 that opens to the exterior of the housing 11. Thus, even when hydraulic oil has a high degree of viscosity under a substantially low-temperature state (for example, −30° C.), pressure in the advance fluid chamber 52 is limited from becoming negative. The above limiting effect of limiting the occurrence of the negative pressure in the fluid chamber 52 is more advantageous specially when the following conditions are satisfied, The average torque $T_{ave}$ of the torque variation is biased in the retard direction, the urging member 120 urges the vane rotor 14 in the advance direction, and pressure of the hydraulic oil from the pump 4 is low at the time of starting the engine 2.

Furthermore, during the phase change in the advance direction, drag force or flow resistance exerted on the air (atmosphere) by the restrictor hole 244*c* of the fluid path arrangement 240 when the air flows through the restrictor hole 244*c* is smaller than drag force exerted on the hydraulic oil when hydraulic oil flows through the restrictor hole 244*c*. As a result, when the fluid path arrangement 240 opens, the air is more likely to be suctioned into the advance fluid chamber 52 from the exterior, and is also more likely to be drained to the exterior by the oil introduced into the advance chamber 52. In contrast, hydraulic oil is less likely to leak out of the advance fluid chamber 52. As a result, speed of the phase change in the advance direction is effectively improved.

Due to the above configuration, it is possible to reliably change the rotational phase from the full retard phase to the start phase region in the advance direction by introducing hydraulic oil into the advance fluid chamber 52 and also into the other advance fluid chambers 53, 54. Furthermore, when the rotational phase reaches the lock phase, it is possible to lock the rotational phase by inserting the first regulation pin 150 into the lock hole 134 in a way described in the operation in the case (I-1). As a result, even in a case, where the rotational phase is out of the start phase region at the time of issuance of the start command, it is possible to change the rotational phase to the lock phase during starting the internal combustion engine 2. As a result, the engine startability is effectively achieved. For example, the lock phase is the most suitable for starting the engine 2 among any phase within the start phase region.

Case (ii-2). When the rotational phase at the time of issuance of the start command is located in a range between the full retard phase and the lock phase, such as a phase shown in FIGS. 8C to 8F, for example, the operation described in case (ii-1) is performed to the apparatus under the corresponding state, where the rotational phase is positioned at the corresponding phase at the time of issuance of the start command. As a result, even in the above case, the rotational phase is changed to the lock phase such that the engine startability is reliably achieved.

Case (ii-3): When the rotational phase at the time of issuance of the start command corresponds to the full advance phase shown in FIGS. 8K and 8L or is in a range between the full advance phase and the lock phase, hydraulic oil is introduced into the advance fluid chambers 52 to 54 in a state, where the restoring force of the opening-closing resilient member 270 maintains the opening-closing pin 260 at the opening position shown in FIG. 9. Accordingly, the rotational phase is adjusted to the full advance phase, and thereby the internal combustion engine 2 is started at the full advance phase, which is included by the start phase region, and thereby it is possible to reliably achieve the engine startability.

Next, case (iii) will be described. The case (iii) shows an example of the operation after the starting of the engine 2 has been completed.

Case (iii): After the completion of the above starting of the engine 2, it is possible to appropriately adjust the valve timing by introducing hydraulic oil from the pump 4 into the advance fluid chambers 52 to 54 or into the retard fluid chambers 56 to 58 in the manner described in the operation of case (III).

As described above, according to the first embodiment, at the time of starting the internal combustion engine 2, the engine startability is reliably achieved regardless of the ambient temperature. Also, after the starting of the internal combustion engine 2 has been completed, it is possible to appropriately adjust the valve timing. It should be noted that in the first embodiment, the regulation pins 150, 220, the regulation resilient members 170, 230, the drive control valve 310, and the control circuit 90 correctively constitute "regulation means". Also, the opening-closing pin 260, the opening-closing resilient member 270, the drive control valve 310, and the control circuit 90 correctively constitute "opening-closing control means". The opening-closing pin 260 serves as an "opening-closing member", and the opening-closing resilient member 270 serves as a "resilient member of opening-closing control means". The drive control valve 310 and the control circuit 90 correctively constitute a "driving force controller".

Second Embodiment

Figure 11:
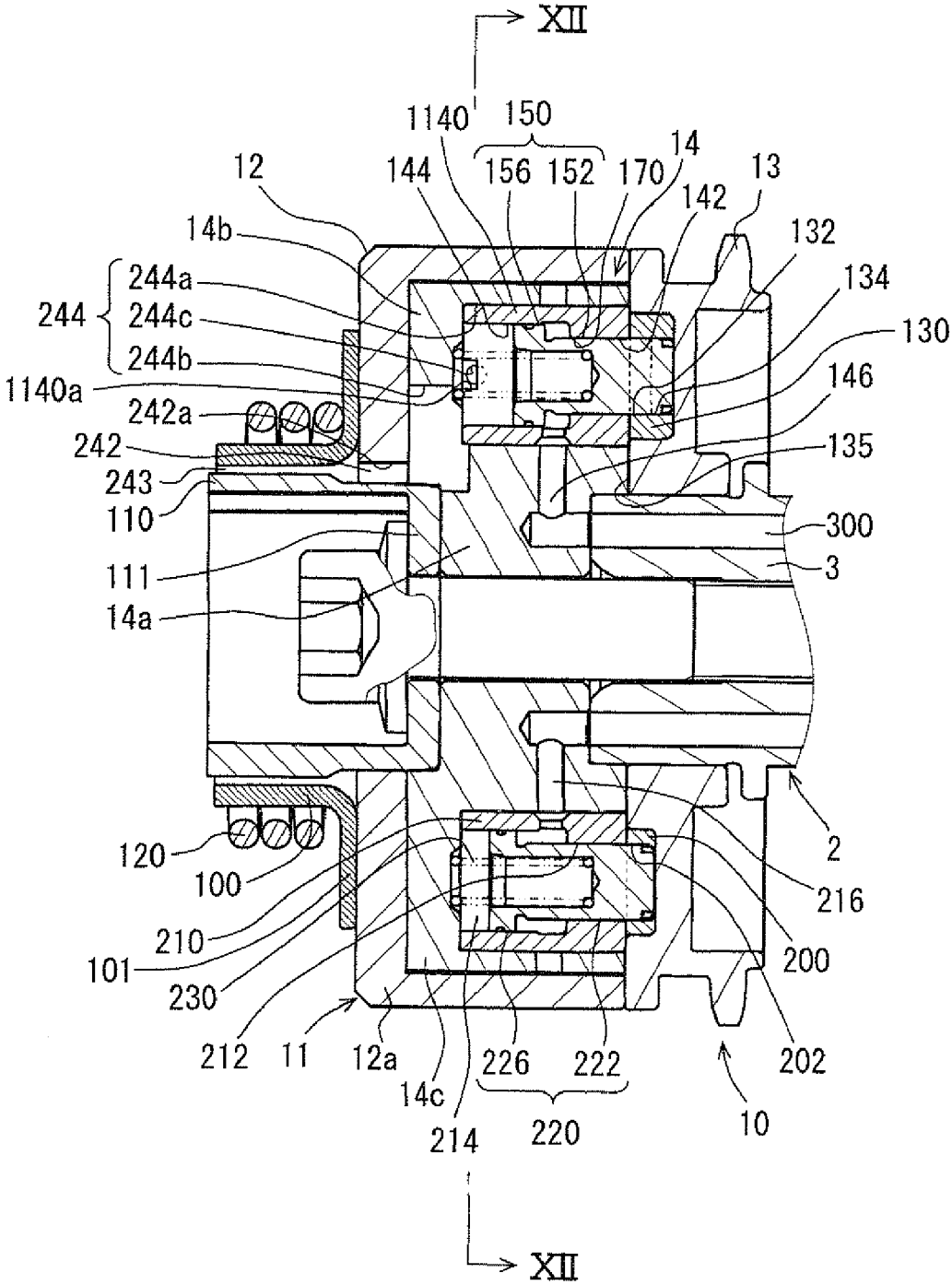
FIG. 11 is a configuration diagram of a valve timing adjusting apparatus according to the second embodiment of the present invention and is a cross-sectional view taken along line XI-XI in FIG. 12.
Figure 12:
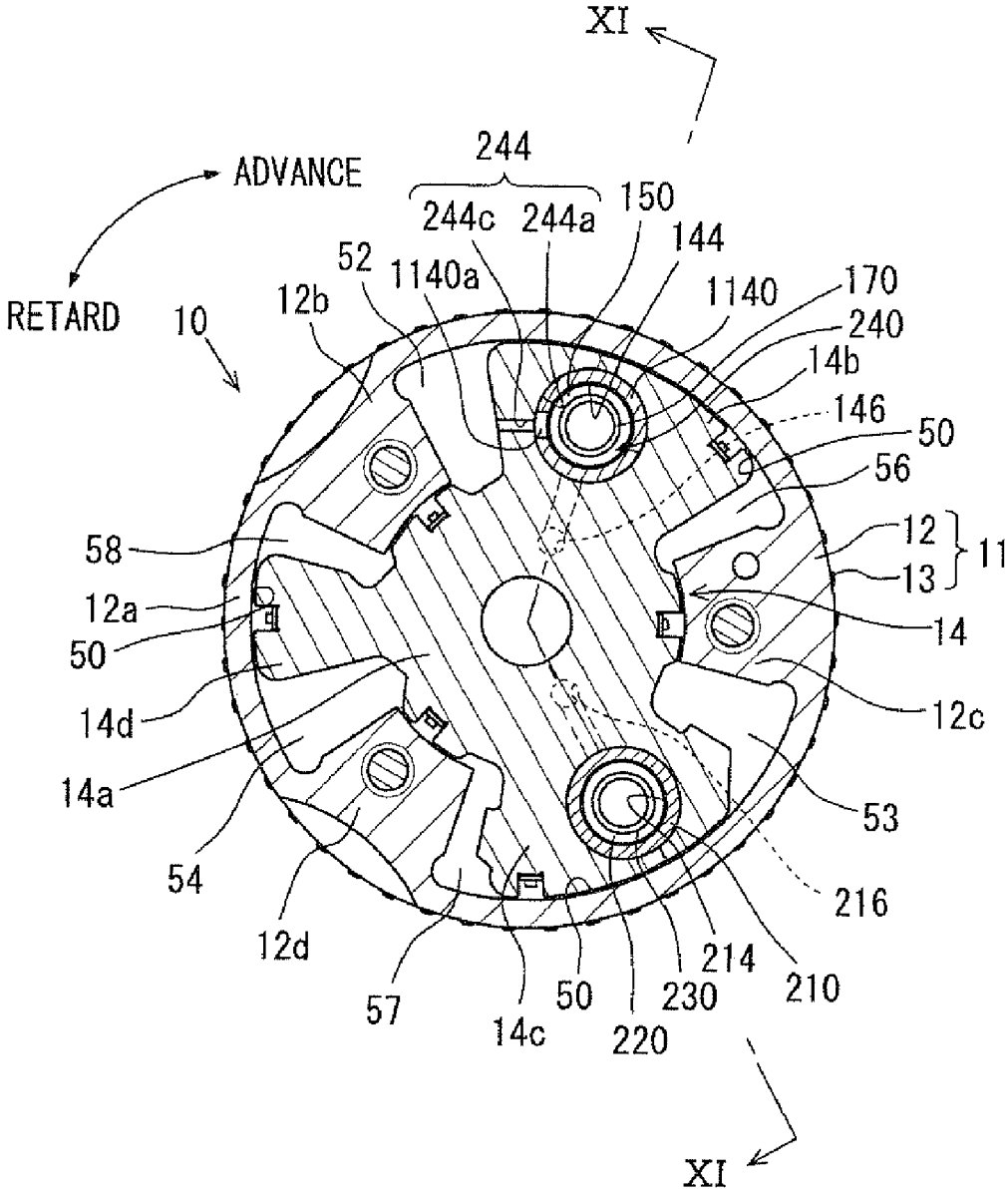
FIG. 12 is a cross-sectional view taken along line XII-XII in FIG. 11.

As shown in FIGS. 11 and 12, the second embodiment of the present invention is modification of the first embodiment. Similar components of a valve timing adjusting apparatus of the present embodiment, which are similar to the components of the valve timing adjusting apparatus of the first embodiment, will be indicated by the same numerals, and the explanation thereof will be omitted. In the second embodiment, the opening-closing control passage 246, the sleeve 250, the opening-closing pin 260, and the opening-closing resilient member 270 are not provided. Instead, a sleeve 1140 is fitted and fixed to the receiver hole 244*a* of the second fluid passage 244 of the fluid path arrangement 240, and the sleeve 1140 receives therein the first regulation pin 150 and the first regulation resilient member 170. The sleeve 1140 of the present embodiment is provided with a communication hole 1140*a* that provides communication between (a) the interior of the receiver hole 244*a* and (b) the connection groove 244*b* and the restrictor hole 244*c*. Otherwise, the sleeve 1140 has a configuration substantially the same with the sleeve 140 of the first embodiment.

Figure 13:
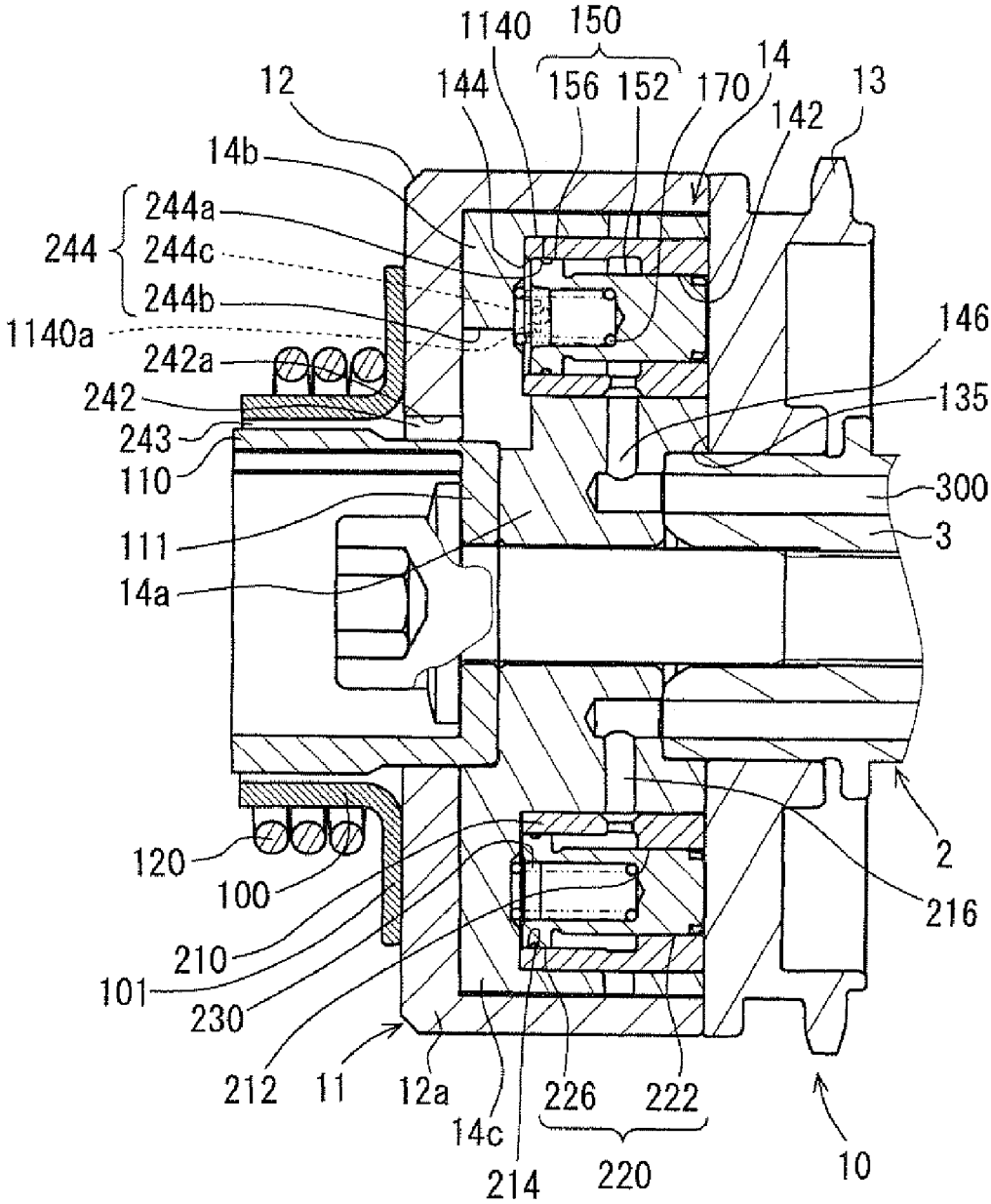
FIG. 13 is a cross-sectional view illustrating an operational state different from that in FIG. 11.

Because of the above configuration, the first regulation pin 150 is displaced to an opening position shown in FIG. 13 such that the first regulation pin 150 is brought into contact with the inner surface 135 of the sprocket member 13 when the rotational phase is at a certain state. The certain state of the rotational phase includes (a) the full retard phase, (b) a phase range between the first regulation phase and the full retard phase, (c) another phase range between the lock phase and the full advance phase, or (d) the full advance phase. Due to the above configuration, the first regulation pin 150 causes the communication hole 1140*a* of the sleeve 1140 within the receiver hole 244*a* to be exposed or to be uncovered such that the second fluid passage 244 of the fluid path arrangement 240 is opened. At the same time, the first regulation pin 150 is disengaged from or stays out of the first regulation groove 132 and the lock hole 134 of the housing 11 because the first regulation pin 150 contacts the inner surface 135. As above, the first regulation pin 150 is displaceable to a position that serves as a "first allowance position", at which the rotational phase is changeable. For example, when the first regulation pin 150 is located at the first allowance position, the rotational phase is changeable is beyond the start phase region.

Figure 14:
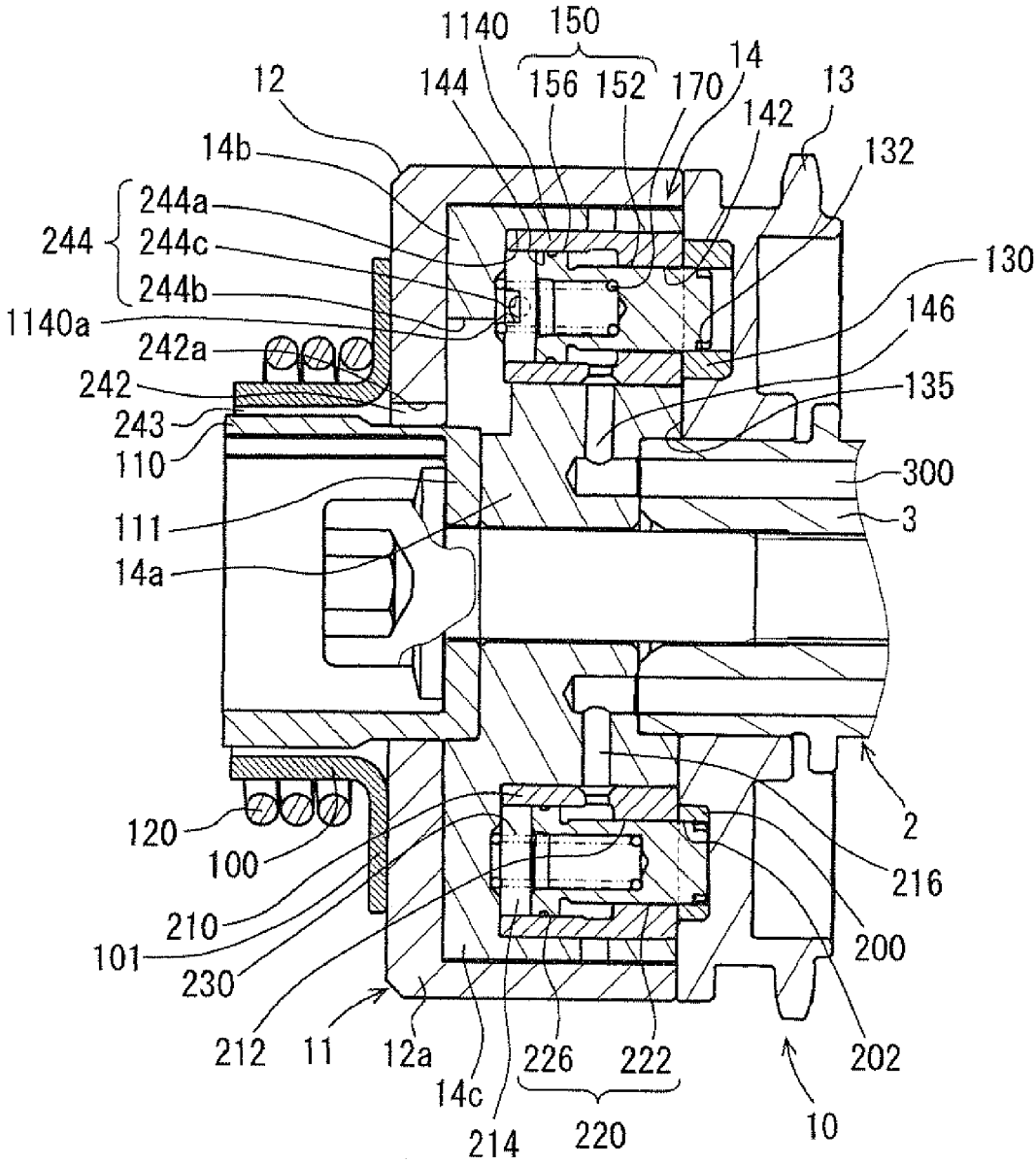
FIG. 14 is a cross-sectional view illustrating an operational state different from those in FIGS. 11 and 13.

Also, in a case, where the rotational phase is in a range between the first regulation phase and the lock phase, the first regulation pin 150 is inserted into first regulation groove 132 when the first regulation pin 150 is displaced to another opening position shown in FIG. 14. Due to the above configuration, the first regulation pin 150 causes the communication hole 1140*a* to be exposed, and thereby the fluid path arrangement 240 is opened. Thus, the first regulation pin 150 is displaceable to a position that serves as a "regulation position", in which the change of the rotational phase is regulated. For example, when the first regulation pin 150 is located at the regulation position, the change of the rotational phase is regulated within the start phase region.

Furthermore, in a case, where the rotational phase is at the lock phase, the first regulation pin 150 is inserted into the lock hole 134 through the first regulation groove 132 when the first regulation pin 150 is displaced to still another opening position shown in FIG. 11. Due to the above configuration, the first regulation pin 150 causes the communication hole 1140*a* to be exposed, and thereby the fluid path arrangement 240 is opened. As above, the first regulation pin 150 is displaceable to a position that serves as the "regulation position", in which the change of the rotational phase is regulated.

Figure 15:
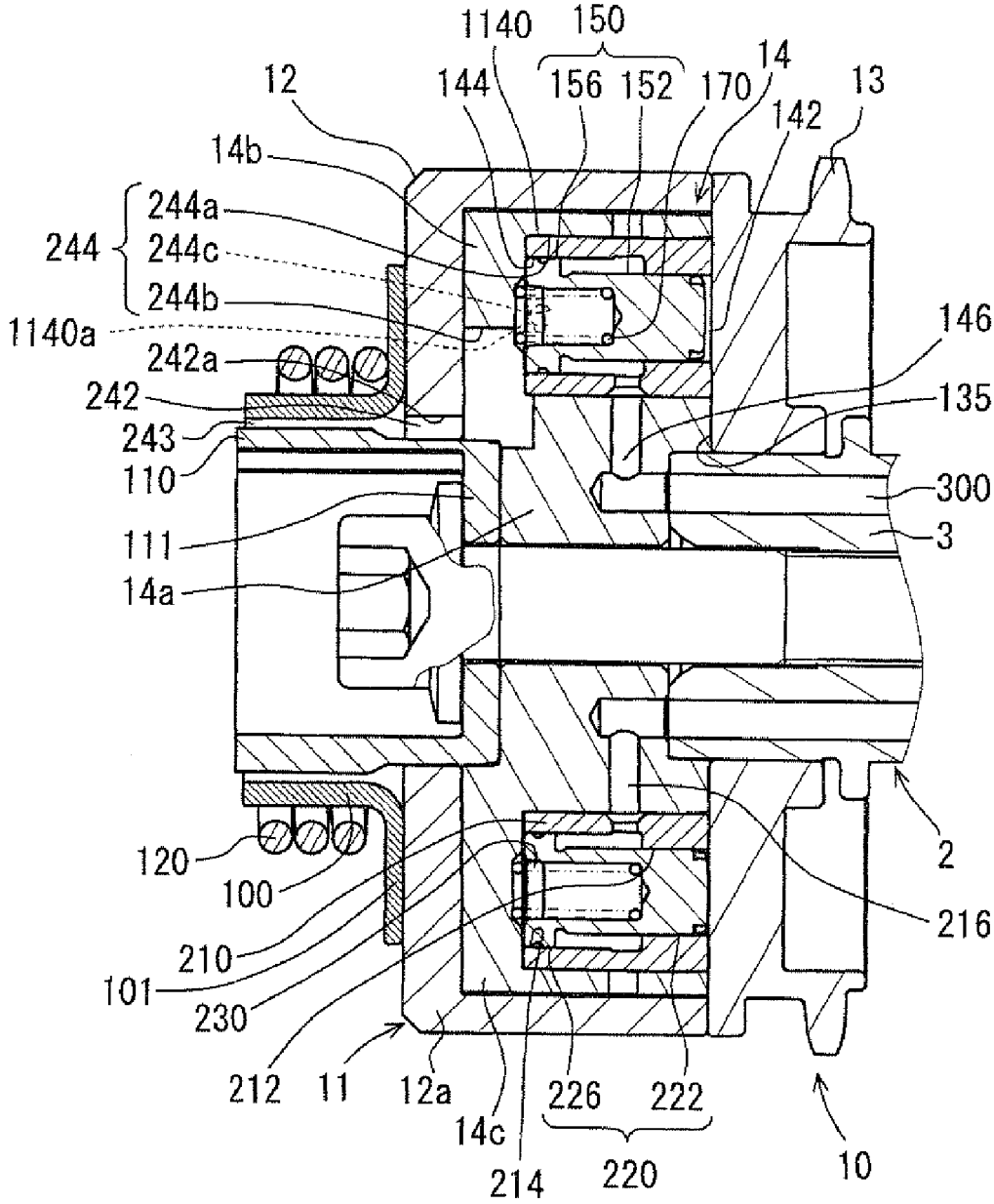
FIG. 15 is a cross-sectional view illustrating an operational state different from those in FIGS. 11, 13, and 14.

Furthermore, in a case, where the rotational phase is at any state, the first regulation pin 150 is positioned away from the inner surface 135 of the sprocket member 13 by displacing the first regulation pin 150 to a closed position shown in FIG. 15 such that the communication hole 1140*a* is closed. As a result, the second fluid passage 244 of the fluid path arrangement 240 is closed. At the same time, because the first regulation pin 150 is positioned out of the first regulation groove 132 and the lock hole 134 of the housing 11 when the first regulation pin 150 is spaced away from the inner surface 135, the rotational phase is changeable. Thus, the first regulation pin 150 is changeable to a position that serves as a "second allowance position", in which the rotational phase is changeable. For example, when the first regulation pin 150 is located at the second allowance position, the rotational phase is changeable is beyond the start phase region.

In the normal operation of the second embodiment, operations based on the control operations described in the case (I) and in the case (II) in the first embodiment are performed, respectively, during the normal stop of the internal combustion engine 2 and at the time of starting the engine 2 after the normal stop. Furthermore, after the starting of the internal combustion engine 2 has been completed, the driving force for driving each of the pins 150, 220 is generated based on the operation described in the control operation described in the case (III) of the first embodiment. As a result, after the completion of the engine start or after the engine 2 becomes self-sustaining, the first regulation pin 150 that receives the first regulation driving force is driven against the restoring force of the first regulation resilient member 170, and thereby the first regulation pin 150 is kept at the closed position shown in FIG. 15. Thus, the fluid path arrangement 240 is maintained closed, and thereby leakage of hydraulic oil from the advance fluid chamber 52 is reliably limited.

In contrast, in the fail-safe operation, the operation described in the case (i) of the first embodiment is performed at the time of the abnormal stop of the internal combustion engine 2. Then, when the engine 2 is to be started after the operation in the case (i) is performed, the hydraulic oil is introduced to the advance fluid chambers 52 to 54 and the driving force of the hydraulic oil for driving each of the pins 150, 220 is kept removed in a manner of the operation described in item (ii) of the first embodiment. As a result, when the rotational phase at the time of the issuance of the start command is positioned on the retard side of the lock phase, the rotational phase is changed in the advance direction in a manner described in the operation of the cases (ii-1), (ii-2) of the first embodiment. Also, at the same time, the restoring force of the first regulation resilient member 170 is applied to the first regulation pin 150. Thus, the first regulation pin 150 is displaced to one of the opening positions shown in FIGS. 11, 13, and 14 correspondingly to the change of rotational phase. As a result, in the above case, during the cranking of the engine 2 until the completion of the starting of the internal combustion engine 2, the rotational phase is locked to the lock phase, and thereby the engine startability is effectively achieved. In contrast, when the rotational phase at the time of the issuance of the start command is positioned on the advance side of the lock phase, the restoring force of the first regulation resilient member 170 urges the first regulation pin 150 toward the inner surface 135 such that the first regulation pin 150 is positioned at the opening position shown in FIG. 13, where there is a clearance between the bottom of the receiver hole 244*a* and the force receiver 156 of the first regulation pin 150. In the above state, in a manner describe in the case (ii-3) of the first embodiment, the rotational phase is adjusted to the full advance phase. As a result, also in the above case, the engine startability is effectively achieved. It should be noted that the operation after the completion of the above starting operation is performed similar to the normal operation of the present embodiment.

As described above, also in the second embodiment, at the starting of the internal combustion engine 2, the engine startability is reliably achieved regardless of the ambient temperature. Also, after the completion of starting the internal combustion engine 2, it is possible to appropriately adjust the valve timing. It should be noted that, in the second embodiment, the first regulation pin 150, the first regulation resilient member 170, the drive control valve 310, and the control circuit 90 collectively constitute "opening-closing control means". The first regulation pin 150 also serves as an "opening-closing member of regulation means shared with opening-closing control means". The first regulation resilient member 170 serves as a "resilient member of opening-closing control means". The drive control valve 310 and the control circuit 90 collectively constitute a "driving force controller".

Other Embodiment

While the present invention has been described in connection with the above embodiments, the invention is not to be interpreted limitedly to those specific embodiments. On the contrary, the invention is applicable to various modifications and equivalents within the spirit and scope of the invention.

Specifically, in the first and second embodiments, a component group of the second regulation groove 202, the second regulation pin 220, and the second regulation resilient member 230 may not alternatively be provided. Also, in the first embodiment, another component group of the first regulation groove 132, the lock hole 134, the first regulation pin 150, and the first regulation resilient member 170 may not alternatively provided. Furthermore, in the second embodiment, the second regulation pin 220 and the second regulation resilient member 230 may be alternatively received in the sleeve 1140 in place of the first regulation pin 150 and the first regulation resilient member 170. Also, instead of the first regulation passage 1467 the second regulation passage 216 may be alternatively communicated with the interior of the sleeve 1140 (the large-diameter hole 144). Thus, the second regulation pin 220 may alternatively serve as an "opening-closing member". It should be noted that in the above case, still another component group of the first regulation groove 132, the lock hole 134, the first regulation pin 150, and the first regulation resilient member 170 may be provided in a manner described in the first embodiment or may not alternatively be provided.

In the first and second embodiments, further another component group of the urging member 120, the housing groove 102 and the rotor groove 112 may not be provided alternatively. Also, in the first and second embodiments, the retard fluid chamber 56 may alternatively serve as a "specific fluid chamber" and may be communicated with the restrictor hole 244*c*. In the above case, hydraulic oil may be introduced into the retard fluid chamber 56 at the time of starting the internal combustion engine 2 that has a start phase region defined on the retard side of the full advance phase.

The present invention may be alternatively applicable to an apparatus that adjusts valve timing of an exhaust valve serving as a "valve" and also to an apparatus that adjusts valve timing of both the intake valve and the exhaust valve.

Additional advantages and modifications will readily occur to those skilled in the art. The invention in its broader terms is therefore not limited to the specific details, representative apparatus, and illustrative examples shown and described.

What is claimed is:

1. A valve timing adjusting apparatus for an internal combustion engine having a camshaft and a crankshaft, wherein the valve timing adjusting apparatus uses hydraulic oil supplied from a supply source to adjust valve timing of a valve that is opened and closed by the camshaft through torque transmission from the crankshaft, the valve timing adjusting apparatus comprising:

a housing that is rotatable synchronously with the crankshaft;

a vane rotor that is rotatable synchronously with the camshaft, wherein: the vane rotor has a vane that defines an advance fluid chamber and a retard fluid chamber that are arranged in the housing in a circumferential direction such that a rotational phase of the vane rotor relative to the housing is changed in an advance direction or in a retard direction when hydraulic oil supplied by the supply source is introduced into a corresponding one of the advance fluid chamber and the retard fluid chamber;

regulation means for regulating change of the rotational phase within a start phase region that is defined between a full advance phase and a full retard phase, wherein when the rotational phase is within the start phase region, the internal combustion engine is allowed to start;

a fluid path arrangement provided inside the housing, the fluid path arrangement communicating with a specific fluid chamber that is one of the advance fluid chamber and the retard fluid chamber into which hydraulic oil is introduced so that the specific chamber is opened to atmosphere through the housing when the rotational phase of the vane rotor is varied to a specific direction while a variable torque is applied to the vane rotor from the camshaft at a time of starting the internal combustion engine in which the rotational phase is out of the start phase region; and opening-closing control means for controlling the fluid path arrangement to be opened and closed, wherein:

the opening-closing control means includes:

an opening-closing member that is displaceable to an opening position, at which the opening-closing member opens the fluid path arrangement, and to a closed position, at which the opening-closing member closes the fluid path arrangement, and wherein:

the fluid path arrangement includes:

a first fluid passage that extends through the housing to communicate interior of the housing with exterior of the housing; and a second fluid passage that is defined in the vane rotor to communicate the specific fluid chamber with the first fluid passage;

the opening-closing member is received in the vane rotor;

the opening-closing member opens the second fluid passage when the opening-closing member is positioned at the opening position; and the opening-closing member closes the second fluid passage when the opening-closing member is positioned at the closed position.

2. The valve timing adjusting apparatus according to claim 1, further comprising:

an urging member that urges the vane rotor in the specific direction.

3. The valve timing adjusting apparatus according to claim 1, wherein:

the vane rotor receives torque from the camshaft in the retard direction in average; and the specific direction corresponds to the advance direction.

4. The valve timing adjusting apparatus according to claim 1, wherein:

the fluid path arrangement has a restrictor member that reduces an area of a passage of the fluid path arrangement, through which fluid flows.

5. The valve timing adjusting apparatus according to claim 1, wherein:

the opening-closing control means further includes:

a resilient member that generates restoring force that urges the opening-closing member toward the opening position; and a driving force controller that controls driving force for driving the opening-closing member toward the closed position against the restoring force.

6. The valve timing adjusting apparatus according to claim 5, wherein:

the driving force controller removes the driving force at a time of starting the internal combustion engine; and the driving force controller generates the driving force after the starting of the internal combustion engine has been completed.

7. The valve timing adjusting apparatus according to claim 5, wherein:

operation of the internal combustion engine causes the supply source to supply hydraulic oil; and the driving force controller generates the driving force by applying pressure of hydraulic oil supplied from the supply source to the opening-closing member.

8. The valve timing adjusting apparatus according to claim 5, wherein:

the regulation means and the opening-closing control means include the opening-closing member which is displaceable between a regulation position at which the opening-closing member regulates change of the rotational phase within a start phase region, a first allowance position at which the opening-closing member opens the fluid path arrangement and causes the rotational phase to be changeable, and a second allowance position at which the opening-closing member closes the fluid path arrangement and causes the rotational phase to be changeable.

* * * * *